US006038415A

United States Patent [19]

Nishi et al.

[11] Patent Number: 6,038,415

[45] Date of Patent: Mar. 14, 2000

[54] IMAGE FORMING APPARATUS AND IMAGE-CARRIER CARTRIDGE DEVICE WHICH IS EMPLOYED IN THE SAME

[75] Inventors: Masayuki Nishi; Hiroshi Murasaki; Toru Matsui, all of Toyokawa, Japan

[73] Assignee: Minolta Co., Ltd., Osaka, Japan

[21] Appl. No.: 09/118,441

[22] Filed: Jul. 17, 1998

[30] Foreign Application Priority Data

| | | | |
|---|---|---|---|
| Jul. 18, 1997 | [JP] | Japan | 9-194487 |
| Jul. 18, 1997 | [JP] | Japan | 9-194505 |
| Aug. 20, 1997 | [JP] | Japan | 9-223943 |
| Jun. 30, 1998 | [JP] | Japan | 10-185215 |

[51] Int. Cl.[7] ..... G03G 21/16; G03G 15/02

[52] U.S. Cl. ..... 399/111; 399/114; 399/115; 399/128

[58] Field of Search ..... 399/110, 111, 399/112, 113, 114, 116, 117, 121, 125, 115, 128

[56] References Cited

U.S. PATENT DOCUMENTS

| | | | |
|---|---|---|---|
| 5,530,537 | 6/1996 | Thayer | 355/298 |
| 5,697,017 | 12/1997 | Rooke et al. | 399/71 |
| 5,754,926 | 5/1998 | Sakuraba et al. | 399/175 |
| 5,845,176 | 12/1998 | Yoshida et al. | 399/113 |

FOREIGN PATENT DOCUMENTS

| | | |
|---|---|---|
| 8-069231 | 3/1996 | Japan . |
| 8-069232 | 3/1996 | Japan . |
| 9-160458 | 6/1997 | Japan . |

*Primary Examiner*—Richard Moses
*Attorney, Agent, or Firm*—Sidley & Austin

[57] ABSTRACT

An image forming apparatus employs an image carrier (photoreceptor) cartridge having protective covers of which surface is coated with conductive shield in order to prevent frictional charging that will bring on sparking between a photoreceptor and covers. Further, the photoreceptor cartridge is equipped on its surface with an elastic member which is a foam body having a plurality of foam cells for catching foreign matter such as paper particles in order to prevent the foreign matter from damaging the surface of the photoreceptor. Moreover, the photoreceptor cartridge is also equipped with a flick member for flicking off toner deposited on a conductive brush in order to prevent the brush from becoming dirty. Owing to the above-mentioned construction, the image forming apparatus can avoid degradation in image quality.

40 Claims, 18 Drawing Sheets

IMAGE FORMING APPARATUS AND IMAGE-CARRIER CARTRIDGE DEVICE WHICH IS EMPLOYED IN THE SAME

This application is based on Patent Applications Nos. 9-194487, 9-194505, 9-223943 and 10-185215 filed in Japan, the contents of which are hereby incorporated by reference.

BACKGROUND OF THE INVENTION

This invention relates generally to an image forming apparatus using a xerography system and an image-carrier cartridge device which is employed in the same. In one aspect, this invention relates to an image-carrier cartridge device having protective covers for preventing an abnormal condition which comes from light reaching a surface of an image carrier (a photoreceptor), and mechanical contact, and especially to an art for preventing frictional charge which occurs on the cover surfaces, and abnormal discharge from the image carrier caused thereby. Further, the invention relates to the image forming apparatus which prevents damages to a photoreceptor caused by foreign matter (e.g., paper particles) gathering and solidifying in foam cells, and prevents filming by rubbing the image-carrier cartridge device. Furthermore, the invention relates to the image forming apparatus which flicks a developer deposited on a conductive brush, and prevents bristles of the brush from bending.

Conventionally, an image carrier such as the photoreceptor which is employed in an image forming apparatus using a xerography system (hereinafter the image carrier is referred to as the photoreceptor), has been formed in a cartridge unit, and loaded into the image forming apparatus for use. This cartridge unit is equipped with protective covers (shutters) which close before loading in the image forming apparatus in order to prevent the abnormal condition caused by light reaching the surface of the photoreceptor or mechanical contact, and open at the time of loading.

However, if the protective covers of the above-mentioned cartridge unit have a low stiffness, the surface of the photoreceptor may be damaged by contact with the protective covers during handling. Also, the protective covers are touched by workers in an assembly line, and rubbed by packing materials during shipment, so that the surfaces of the protective covers, which are made of resin materials, may be charged with frictional electricity. If the frictional charging settles dust on the surfaces (both of inner and outer sides) of the protective covers, the dust will be transferred onto the surface of the photoreceptor, which will bring on the adverse effect.

Moreover, when the cartridge unit is loaded into the image forming apparatus in a state wherein the protective covers are charged with frictional electricity on the surface thereof, and when the protective covers are opened, sparking is prone to occur between the protective covers and the photoreceptor. In such a case, the sparking damages the photoreceptor (photoreceptive layer), thereby generating pinholes. This causes various kinds of image noise (such as so-called black line).

An action of generating the above-mentioned phenomenon is illustrated in FIG. 7. When the protective covers facing the photoreceptor are opened in a state of being charged with frictional electricity, the sparking between the protective covers and the photoreceptor makes pinholes on the photoreceptor. The electricity is charged onto the damaged photoreceptor by a pre-charge film, abnormal discharge occurs at points of the pinholes, and toner fuses and develops as a result of the discharging heat. If an image on the photoreceptor is developed by a developing roller in this state, it will not develop properly.

Further, there has been proposed an image forming apparatus of the cleaner-less type in which the developer remaining on the photoreceptor surface is not removed by a cleaner. In this type of the image forming apparatus, the electrostatic latent image is formed by exposing the surface of the photoreceptor which is charged by a conductive brush. Then, the latent image is revealed with the developer, and transferred onto the paper. After that, a developing-cleaning means collects the developer which remains on the photoreceptor without being transferred onto the paper in the latest printing operation.

If various sorts of papers are used for forming the images, wherein foreign matter such as paper particles is deposited on the photoreceptor, then these foreign matter is also gathered together with the developer. Using the developer which contains the foreign matter, causes degradation in the images. To deal with the above-mentioned problem, an image forming apparatus has been proposed wherein an elastic member, which is a foam body having a plurality of foam cells of 0.1–1.0 mm in diameter, is pushed onto the photoreceptor in order to remove the foreign matter, such as the paper particles deposited on the photoreceptor, and let the developer remaining on the photoreceptor pass through.

However, in the above-mentioned image forming apparatus, the foreign matter such as the paper particles deposited on the photoreceptor gathers and solidifies in the foam cells, and the solidified matter may damage the photoreceptor. Further, in the image forming apparatus of the cleaner-less type, the surface of the photoreceptor may be filmed (this phenomenon is hereinafter referred to as filming). The filming should be avoided since it causes various problems such as nonuniformity in charging, exposing and developing.

Moreover, in the image forming apparatus using the conductive brush for charging the photoreceptor surface with electricity, toner remaining on the photoreceptor may be deposited on the photoconductive brush. The deposited toner makes the brush dirty, which may bring on degradation in charging, and bring on image noise or filming. Accordingly, a flick member is provided to touch the brush in order to remove the deposited toner.

However, if the flick member always touches with the brush, fiber bristles planted in the conductive brush are bent. The bent bristles cause degradation in charging and image quality.

SUMMARY OF THE INVENTION

This invention is made to solve the above-mentioned problems. The first object of the present invention is to provide an image forming apparatus and an image-carrier cartridge device which is employed in the same, wherein the image-carrier cartridge device has the capabilities of preventing the surface of the image carrier from being damaged by contact with protective covers, and of lowering the potential level of frictional charging on the surfaces of the protective covers in order to prevent sparking between the protective covers and the image carrier, so as to prevent damage to the image carrier (photoreceptive layer) caused by the sparking, thereby preventing image noises.

The second object of the present invention is to provide an image forming apparatus capable of removing foreign matter, such as the paper particles deposited on the image carrier, and capable of preventing damage to a photoreceptor caused by foreign matter (e.g., paper particles) which gathers and solidifies in foam cells.

The third object of the present invention is to provide an image forming apparatus capable of preventing filming in order to prevent nonuniformity in charging, exposing and developing.

The fourth object of the present invention is to provide an image forming apparatus capable of flicking developer, deposited on a conductive brush, in order to prevent the brush from becoming dirty, and capable of preventing the brush bristles from bending, thereby avoiding degradation in charging which causes degradation in image quality.

In order to achieve the above-mentioned objects, according to one aspect of the present invention, an image forming apparatus comprises a cartridge which contains an image carrier, a casing having an opening for opening up an predetermined area of said image carrier, a cover for covering and uncovering the opening of said casing, and a shield arranged on a surface of said cover facing the image carrier. The image forming apparatus further comprises a holder for holding the cartridge and a mechanism which opens the cover of the cartridge to be loaded in the holder.

According to a further aspect of the present invention, an image carrier cartridge comprises an image carrier; a casing which covers said image carrier, and which has an opening to a predetermined area of the image carrier; a cover for covering and uncovering the opening of the casing; and a shield which is arranged on a surface of the cover facing the image carrier.

According to a further aspect of the present invention, an image forming apparatus comprises an image carrier; an electrostatic latent image forming device for forming an electrostatic latent image on a surface of the image carrier; a developing device for revealing the electrostatic latent image on the surface of the image carrier with a developer; a transfer device for transforming the image on the surface of the image carrier which has been revealed by the developer; a collecting device for collecting the developer remaining on the surface of the image carrier after transferring the image; and, an elastic member which is in pressure contact with the surface of the image carrier between the transfer device and the collecting device, and which has a plurality of foam cells of 0.1–1.0 mm in diameter.

BRIEF DESCRIPTION OF THE DRAWINGS

FIG. 21(*b*) is a partial side view of the mechanism of FIG. 21(*a*).

DETAILED DESCRIPTION OF THE PREFERRED EMBODIMENT OF THE PRESENT INVENTION

Now, the first embodiment of the present invention will be explained with reference to the drawings. In this embodiment, the present invention is employed to a laser printer which is a type of image forming apparatus.

Figure 1:
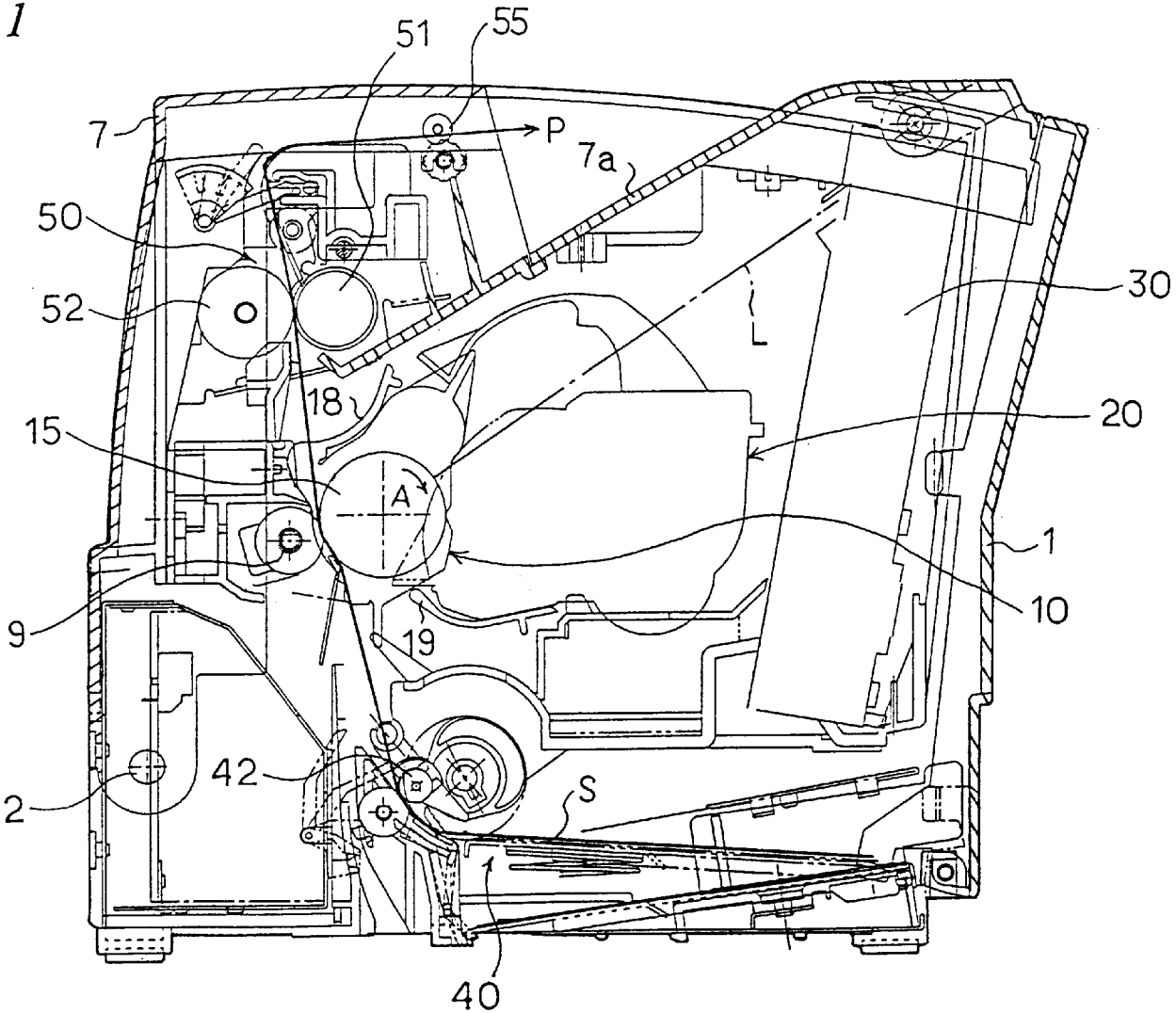
FIG. 1 is a cross-sectional view of a laser printer according to the first embodiment of the present invention.
Figure 2:
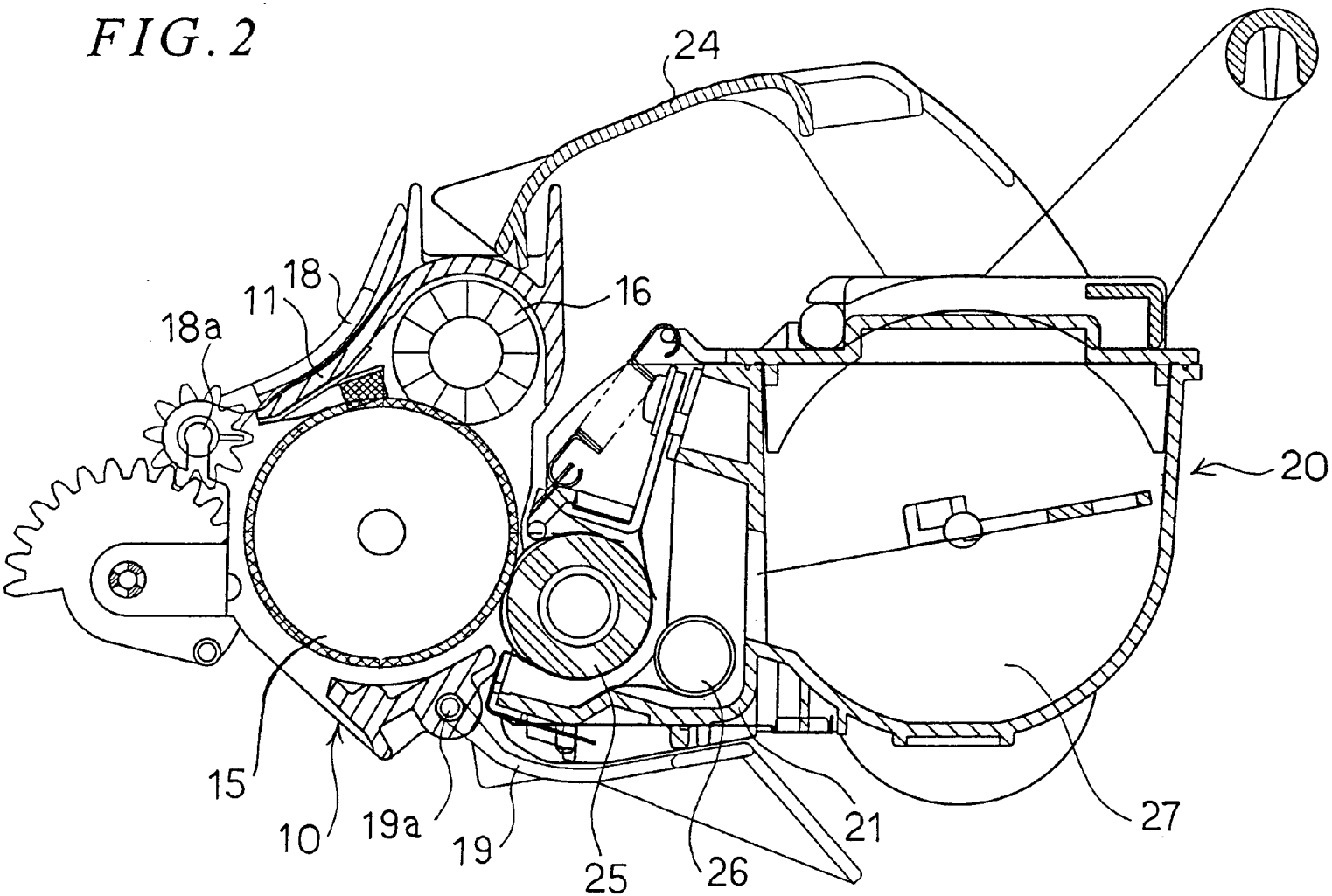
FIG. 2 is a cross-sectional view of a photoreceptor unit of the present invention and a developing unit mounted in the laser printer.

As shown in FIGS. 1 and 2, the laser printer is equipped with a frame consisting of a fixed frame 1 and a movable frame 7. The movable frame 7 turns on a pivot 2 which is arranged in the fixed frame 1. The fixed frame 1 encloses a photoreceptor unit 10, a developing unit 20, a laser exposure unit 30 and a paper feed unit 40. The photoreceptor unit 10 and the developing unit 20 act as an image-carrier cartridge unit. The laser exposure unit 30 emits and polarizes a laser beam which is modulated based on external image signal. The paper feed unit 40 feeds sheets of paper S. The photoreceptor unit 10 and the developing unit 20 are removable from a laser printer body. The movable frame 7 encloses a fixing unit 50 consisting of a pair of thermal rollers 51 and 52, and a printout tray 7*a*. Opening the movable frame 7 opens up a paper conveying path for removing a jammed paper, and replacing the photoreceptor unit 10 and a developing unit 20.

The photoreceptor unit 10 contains a photoreceptor 15 and a conductive brush 16 in a casing 11 thereof. The photoreceptor 15, shaped like a cylindrical drum, is driven to rotate into a direction of an arrow A. The brush 16 charges a surface of the photoreceptor 15 with static electricity.

The developing unit 20, contains in a casing 21 thereof, a developing sleeve 25, a stirring roller 26, and a toner tank 27 in which toner is stored. The toner in the tank 27 is stirred and charged with carrier by the roller 26, and then supplied into the sleeve 25.

The laser exposure unit 30 generates a modulated laser beam L (shown by a center line in FIG. 1). The laser beam L, polarized by a polygonal mirror, scans the surface of the photoreceptor 15.

The paper S is conveyed from the paper feed unit 40 into the paper conveying path (shown by an arrow P) by a paper feed roller 42, and fed into a transfer area which consists of the photoreceptor 15 and a transfer roller 9 facing to the photoreceptor 15. In the transfer area, an image on the photoreceptor 15 is revealed by the toner, and transferred onto the paper S. The paper S is further conveyed into the fixing unit 50 for fixing the image, and then conveyed into the printout tray 7*a*.

The structures of the laser exposure unit 30, paper feed unit 40 and fixing unit 50, and the image forming process (such as an exposure, developing, transfer) in the laser printer are the same as those of the conventional art, so that no explanation is provided thereof.

Figure 3:
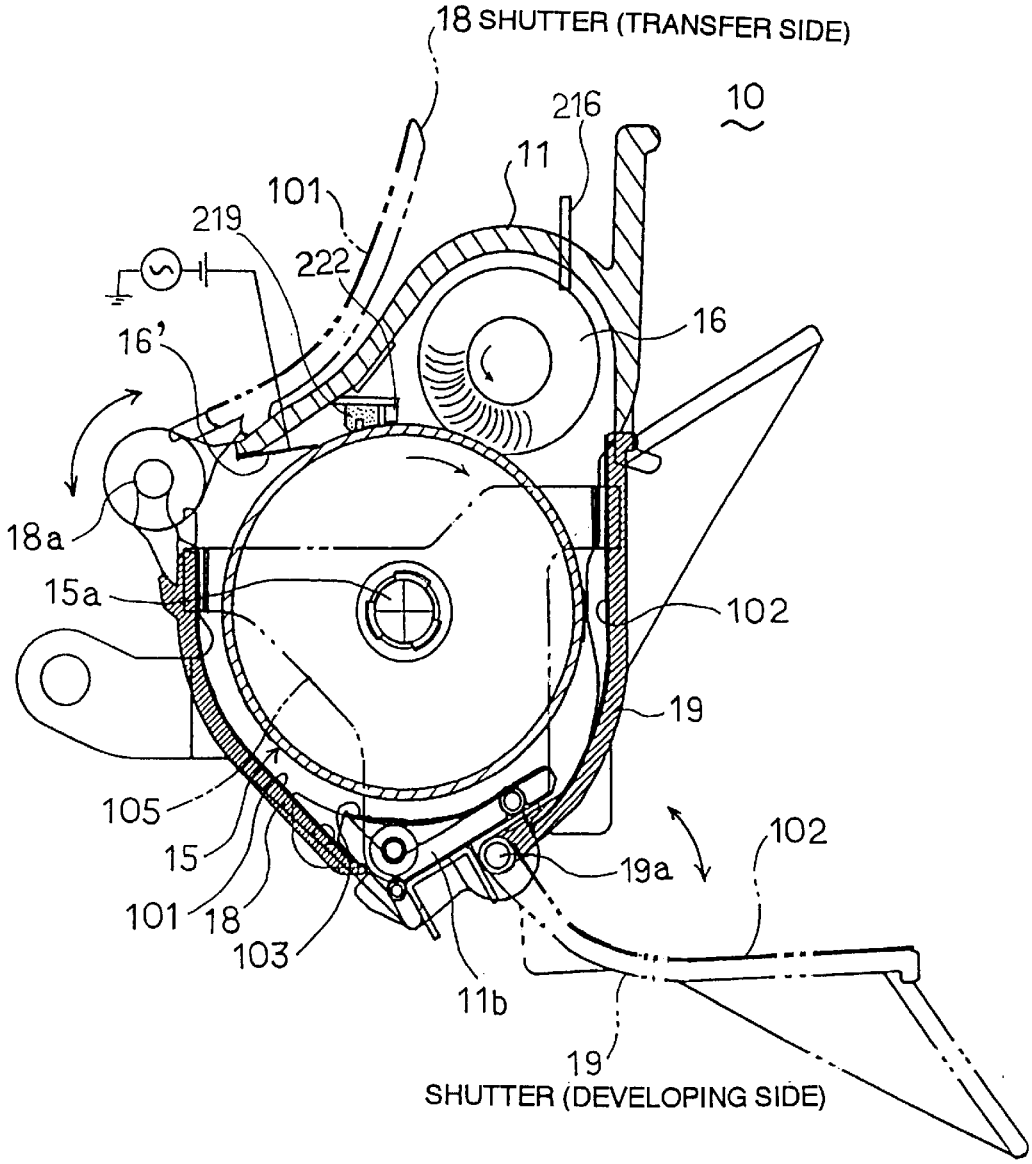
FIG. 3 is a cross-sectional view of the photoreceptor unit of the present invention.

As shown in FIG. 3, the photoreceptor unit 10 comprises a first shutter (protective cover) 18 and a second shutter (protective cover) 19 which are openably arranged in an opening of the casing 11, and are made of resin materials. In addition, the photoreceptor unit 10 is provided with a flick member 216, an elastic member 219 and a flexible member 222 which will be described later. Also, as shown in FIG. 2, the developing unit 20 comprises a shutter (protective cover) 24 which is openably arranged in an opening of the passing 21. When each of units is removed from the laser printer body, or when the movable frame 7 is opened up, each of shutters 18, 19 and 24 protects the surface of the photoreceptor 15 and the developing sleeve 25 from light and/or mechanical contact. Although the shutters 18 and 19 are structured so as to open at the time of loading the photoreceptor unit 10 into the laser printer in the present embodiment, it is also possible to structure such that the shutters 18 and 19 will open at the time of activating the laser printer.

The shutter 18 (transfer side) of the photoreceptor unit 10 is rotatably arranged into a pin 18*a* which is disposed in the casing 11, and the shutter 18 is normally urged into a counterclockwise direction (direction toward the photoreceptor 15) by an unshown torsion spring. When the photoreceptor unit 10 is removed from the laser printer body, or when the movable frame 7 is opened up, the shutter 18 closes by a spring force of the torsion spring, and covers and protects the transfer area on the photoreceptor 15. Turning the movable frame into the closing direction has an unshown projection of the movable frame 7 which pushes up on the shutter 18. Accordingly, the shutter 18 rotates in a clockwise, direction pivoting on the pin 18*a*, and uncovers the transfer area on the photoreceptor 15. This state is shown by phantom chain lines in FIG. 3.

The shutter 19 (developing side) of the photoreceptor unit 10 is rotatably arranged into a pin 19*a* which is disposed in the casing 11, and the shutter 19 is normally urged into a counterclockwise direction (direction toward the photoreceptor 15) by an unshown torsion spring. When the developing unit 20 is removed from the laser printer body, the shutter 19 closes by a spring force of the torsion spring, and covers the developing area on the photoreceptor 15 which is opposite to the developing sleeve 25. Consequently, before loading the developing unit 20 into the laser printer body, the shutter 19 covers and protects the developing area on the photoreceptor 15. When the developing unit 20 is loaded in the fixed frame 1 along an unshown guide groove, a corner of the casing 21 pushes down the shutter 19. Accordingly, the shutter 19 rotates pivoting on the pin 19*a* in the clockwise direction, and uncovers the developing area on the photoreceptor 15. This state is shown by the phantom lines.

The developing unit 20 comprises the shutter 24 which composes one part of the casing 21. When the developing unit 20 is removed from the laser printer body, the shutter 24 closes for covering and protecting the developing sleeve 25. Also, linking with the developing unit 20 loaded into the laser printer body, the shutter 24 is rotated upward by the corner of the photoreceptor unit 10, which uncovers the developing sleeve 25.

Figure 4:
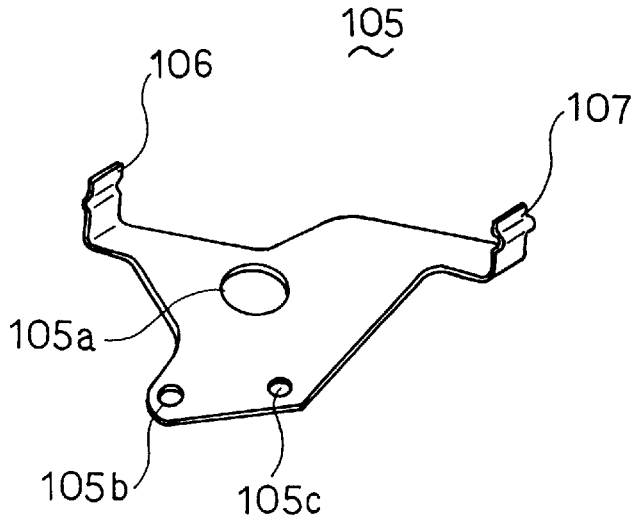
FIG. 4 is a perspective view of a grounding plate of the present invention.

As shown in FIG. 3, the first and second shutters 18 and 19 of the photoreceptor unit 10 have inside surfaces which are entirely or partially coated with electrically-conductive shields 101 and 102. In the casing 11, a hinge 11*b* is fixed on a wall between the openings on the transferring and developing sides. The hinge 11*b* also has an inside surface which is coated with an electrically-conductive shield 103. The shields 101, 102 and 103 are made by electrically-conductive film, conductive foam sheet materials such as thin-copper tape, conductive polyurethane, or Kuropoli™ (a conductive film made from carbon and polyethylene by the Achilles Co.) which have flexibility, and in which electrical resistance is reduced. At least one end of the casing 11 of the photoreceptor unit 10 is equipped with a grounding plate 105 which is made by the conductive materials. The grounding plate 105 becomes at the same potential as a ground by electrical contact with a photoreceptor spindle 15*a* (body of the photoreceptor 15) which is connected to the ground. As shown in FIG. 4, the grounding plate 105 comprises bent-spring plates 106, 107, a through hole 105*a* for the drum spindle 15*a*, and screw holes 105*b*, 105*c* for mounting the hinge 11*b*.

When the shutters 18 and 19 are closed, the conductive shields 101 and 102 are short-circuited with the spindle 15*a* (body of the photoreceptor 15) by contacting with the spring plates 106 and 107 of the grounding plate 105. This short-circuit state is maintained until the shutters 18 and 19 are partially opened. It is also possible to make a structure in which the short-circuit state is maintained until the photoreceptor unit 10 is completely loaded into the laser printer body. Also, the shield 103 of the hinge 11*b* is short-circuited with the grounding plate 105. Further, in the casing 11, there is provided a pre-charge sheet 16' for being charged with electricity by contacting with the photoreceptor 15 at an upstream to the brush 16.

As described above, the shutters 18, 19 and the hinge 11*b* of the photoreceptor unit 10 are provided respectively with the conductive shields 101, 102 and 103. Consequently, even if the shutters 18 and 19 contact with the surface of the photoreceptor 15, the shields lessen an impact of a shock coming from the contact, and prevent the photoreceptor 15 from being damaged. Further, the shields prevent the surfaces of the shutters 18 and 19 from being charged with frictional electricity. This makes it possible to lower the level of electrical charge due to friction on the outer surface of the shutters 18 and 19 to one-fourth or less of that on the inner surface, and to prevent dust from settling on the surface. Besides, the short-circuit state occurs between the spindle 15*a* (body of the photoreceptor 15), and the shields 101, 102 and 103, thereby eliminating the potential difference therebetween. Accordingly, this prevents sparking therebetween, and prevents pinholes on the photoreceptive layer which are caused by the sparking.

Figure 5:
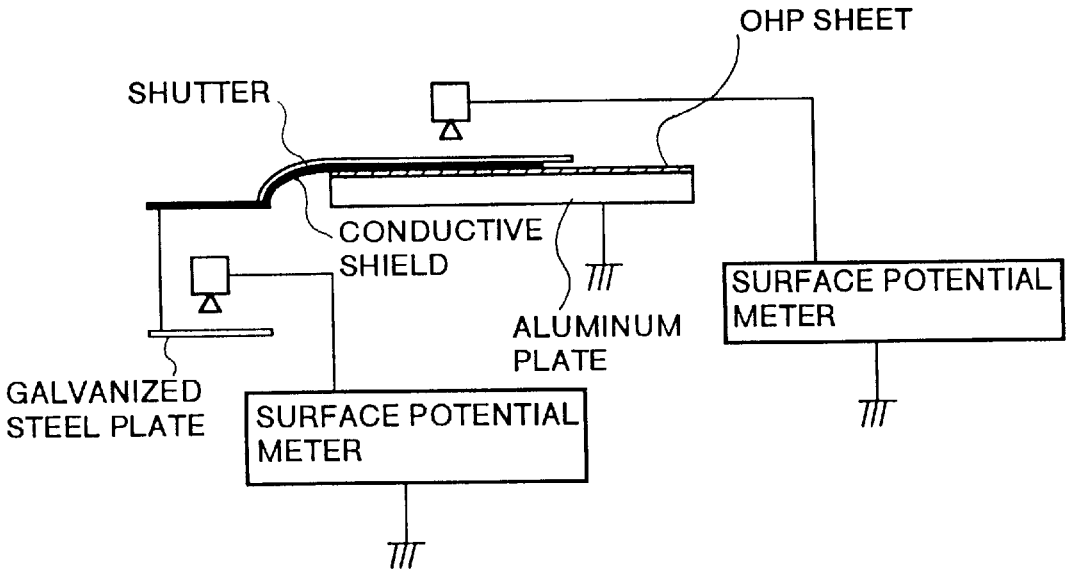
FIG. 5 is a schematic view of an experimental setup to confirm a reduction in frictional charging level.
Figure 6:
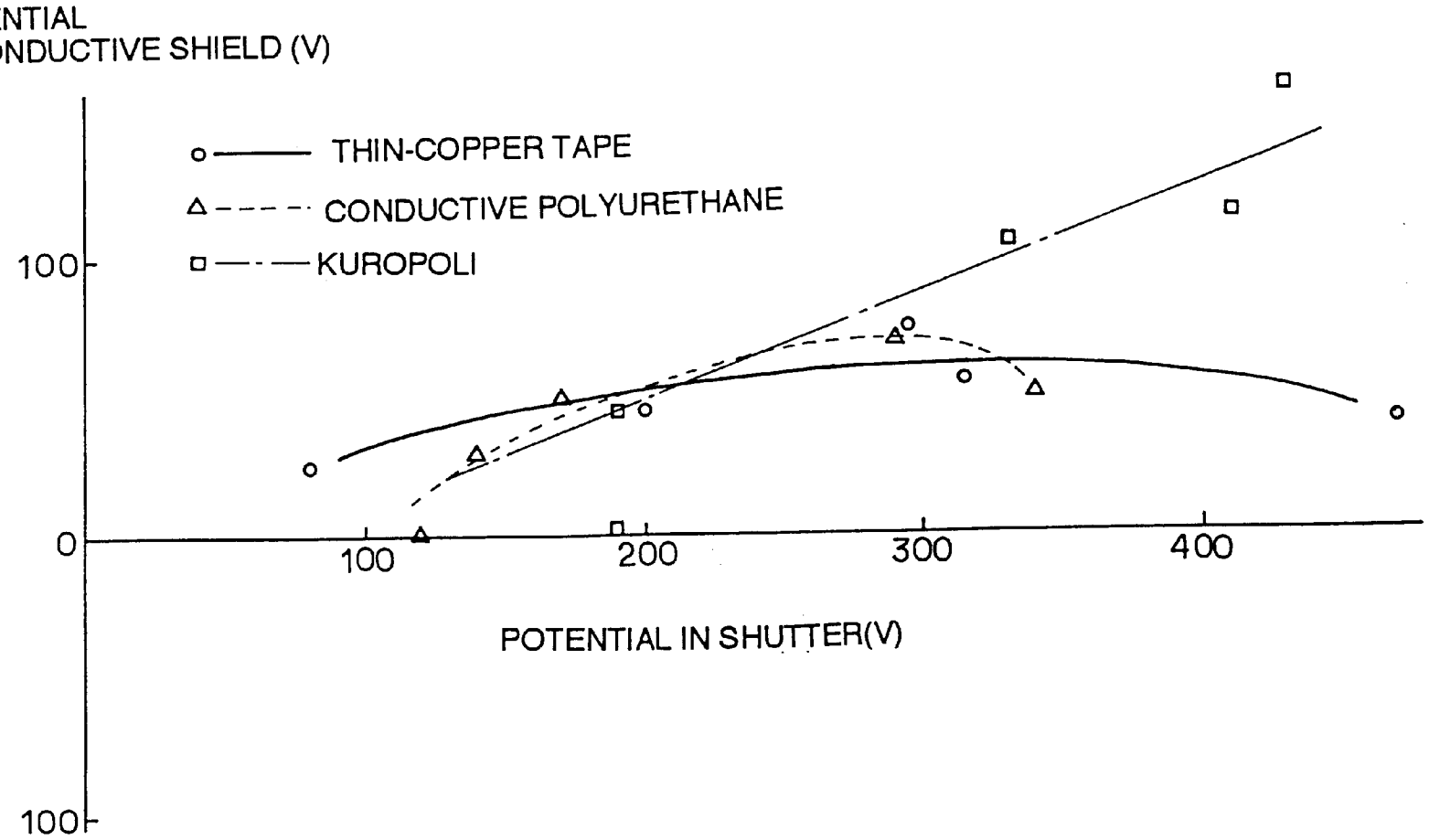
FIG. 6 is a graph of the potential in a shutter versus potential in a conductive shiled for each of the conductive members.
Figure 7:
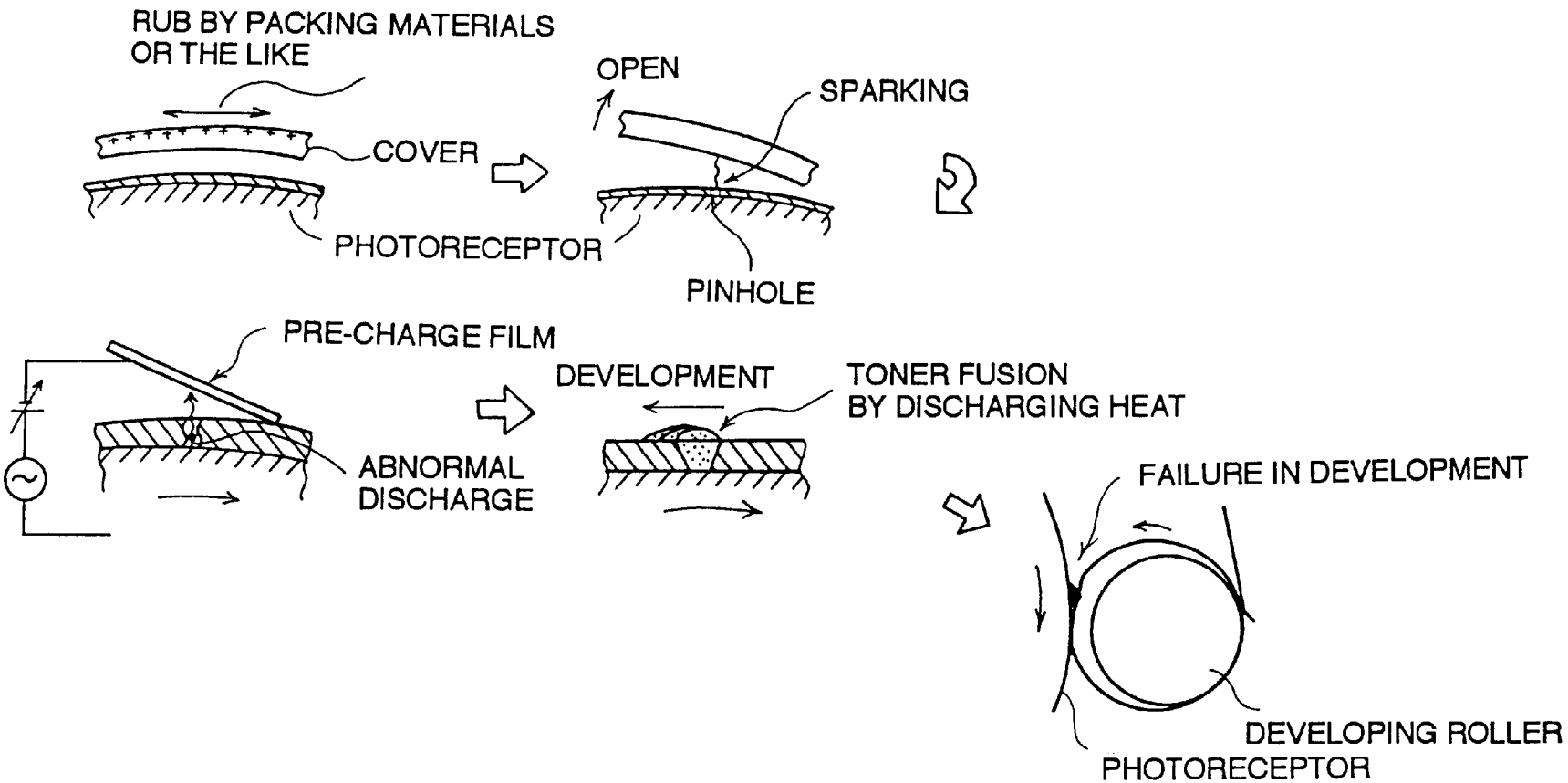
FIG. 7 is a schematic view of the generation of a spark between a protective cover and a photoreceptor and the results thereof.

FIG. 5 illustrates the reduction in frictional charging level. The shutter is provided with the conductive shield, and the underside of the conductive shield is coated with an aluminum plate as an opposite electrode for the measurement by a surface-potential meter. The aluminum plate is grounded through an OHP (over-head projector) sheet. The conductive shield is made by the thin-copper tape, conductive polyurethane, and Kuropoli™ (13 mm wide×60 mm long). The potentials in the shutter and the conductive shield are measured after rubbing measuring points 20 times with an electrostatic mop. The result is shown in FIG. 6. As shown in the figure, whereas the potentials in the shutter take on voltages from 100V to 400V, the potentials in the conductive shield take on voltages around 60V. Connecting the conductive shields to the ground makes the charge potential 0V. The resistance in the conductive shield is desired to be $10^8$ cm or less.

Figure 8:
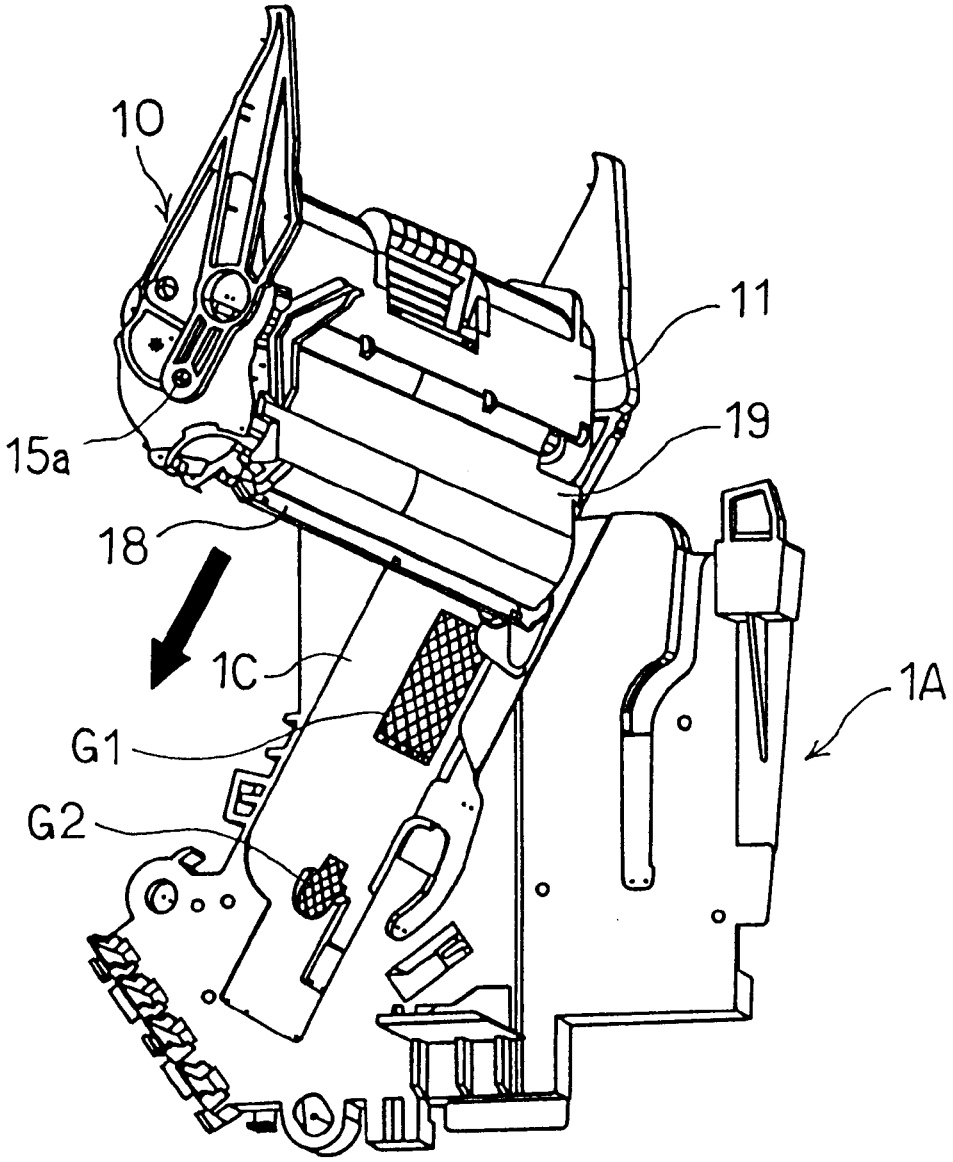
FIG. 8 is a perspective view showing the insertion of the photoreceptor unit into the laser printer when viewed from a slanting lower direction.
Figure 9:
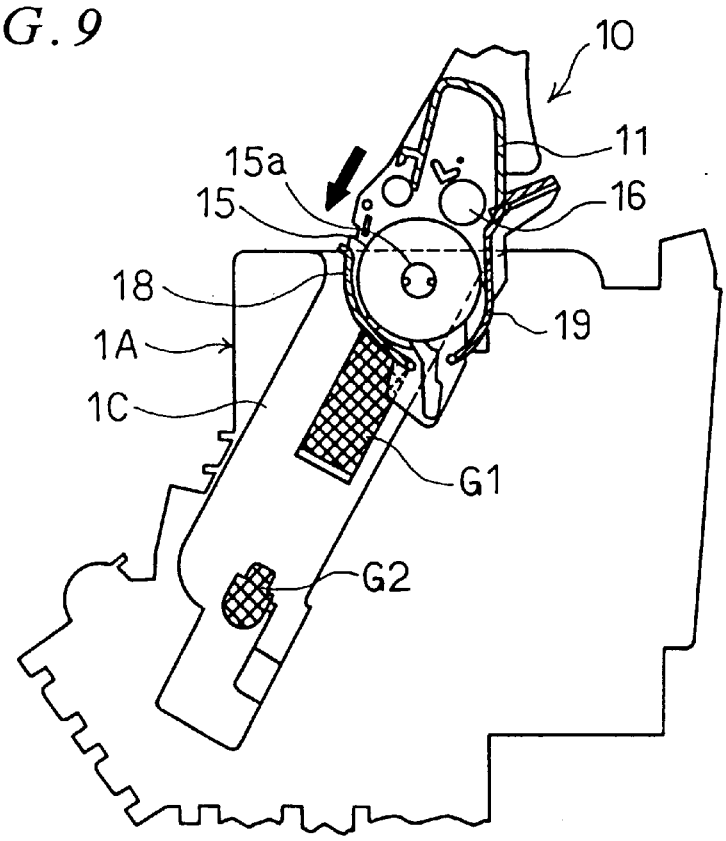
FIG. 9 is a side view showing the insertion of the photoreceptor unit into the laser printer.
Figure 10:
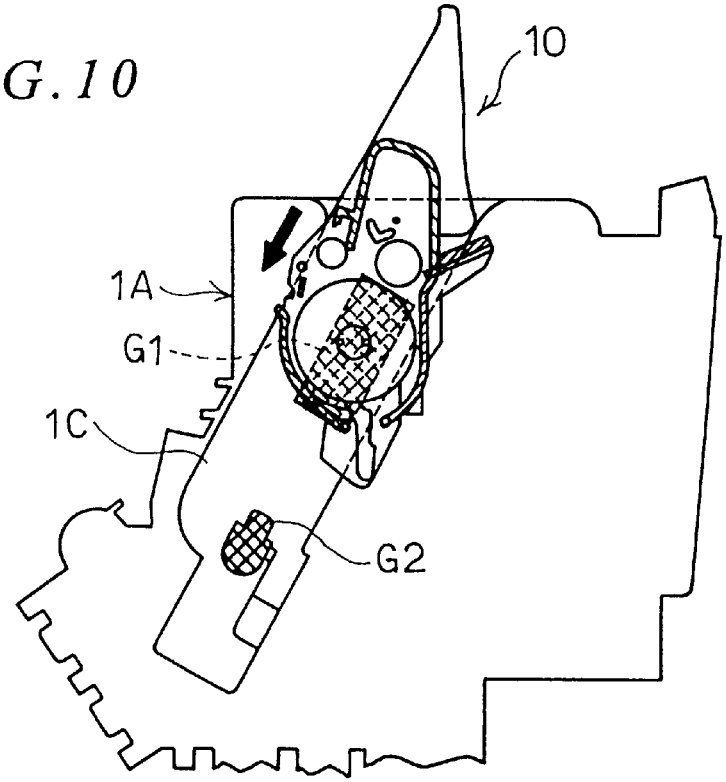
FIG. 10 is a side view showing the further insertion of the photoreceptor unit into the laser printer.
Figure 11:
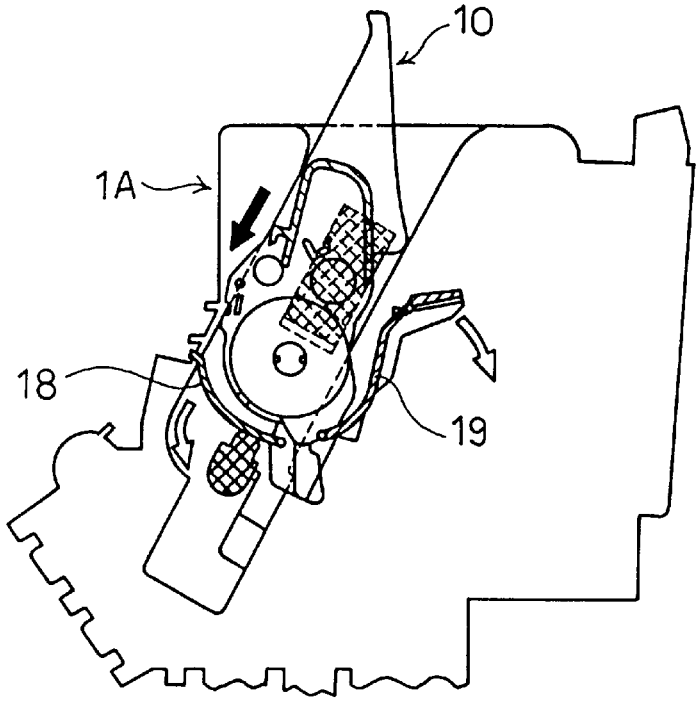
FIG. 11 is a side view showing yet the further insertion of the photoreceptor unit into the laser printer.
Figure 12:
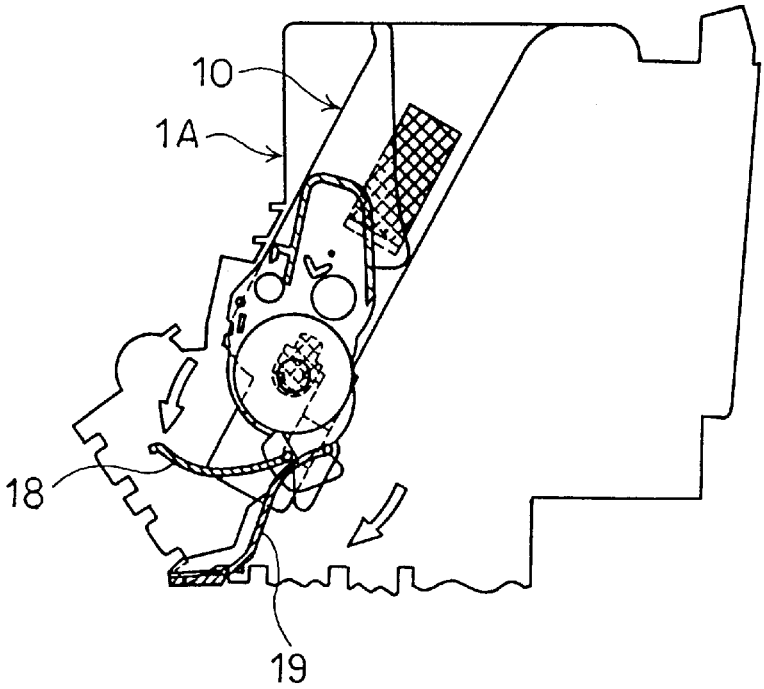
FIG. 12 is a side view showing the further insertion of the photoreceptor unit into the laser printer.

FIG. 8 is a perspective view showing a state of inserting the photoreceptor unit 10 into the image forming apparatus (laser printer) when viewed from a slanting lower direction. The fixed frame 1 is equipped at its right and left sides with a pair of body-guides 1A (the guide in the front is omitted in the figure) which have guide grooves 1C for inserting the photoreceptor 15. The guide 1A has a function for supporting the developing unit 20 as well as the photoreceptor unit 10. The photoreceptor unit 10 and developing unit 20 which can be replaced by a user, are guided by the guide groove 1C, and loaded from above into a slanting lower direction (direction shown by a bold arrow in the figure). The guide 1A has body-side grounds G1 and G2 structured by a conductive plate on the route for inserting the photoreceptor unit 10. The spindle 15*a* (one of the ends which is not seen in FIG. 8) is electrically connected with the body of the photoreceptor unit 10, and structured as a cartridge-ground contact point. The cartridge-ground contact point comes into contact with the grounds G1 and G2 when the photoreceptor unit 10 is inserted into the apparatus, by which, the body of the photoreceptor unit 10 is grounded.

In FIGS. 9–12 illustrating in order the insertion of the photoreceptor unit 10 into the apparatus, one of the body-guides 1A is viewed from the inside of the apparatus. The photoreceptor unit 10 is identical with the one shown in FIG. 3 except that it has the shutter 18 as the protective cover (transferring side) which opens in the reverse direction of that shown in FIG. 3. Before inserting the photoreceptor unit 10 into the apparatus, the shutters 18 and 19 are closed. In this state, the conductive shields (101 and 102 in FIG. 3) which are arranged on the inner surface of the shutters 18 and 19, are in the short-circuit state with the spindle 15*a* as the cartridge-ground contact point.

In a step of inserting the photoreceptor unit 10 into the apparatus, the drum spindle 15*a* as the cartridge-ground contact point comes into contact with the body-side ground G1, thereby becoming short-circuited. Accordingly, the conductive shields of shutters and the body of the photoreceptor unit 10 are grounded, by which the frictional charging levels on the shutter surfaces can be reduced to 0. Further inserting the photoreceptor unit 10 starts the shutters 18 and 19 opening in the direction shown by the arrows. At this time, the conductive shields on the shutter surfaces are shut off from the ground. At the time that the photoreceptor unit 10 is completely inserted in the apparatus, only the body of the photoreceptor unit 10 is grounded and contacted with the body-side ground G2. It is possible to use the grounds G1 and G2 in common.

As mentioned above, the body of the photoreceptor unit 10 and conductive shields on the shutters are together grounded at the time of inserting the photoreceptor unit 10 into the apparatus. However, it is also possible to make a structure in which the conductive shields on the shutter surface are grounded prior to the body of the photoreceptor unit 10. As the conductive shields on the shutter surface are grounded prior to or together with the body of photoreceptor unit 10, the conductive shields of the shutters (protective covers) are maintained lower than or equally to the photoreceptor unit 10 (image carrier) in frictional charging potential. This prevents pinholes caused by the sparking from the protective cover.

Now, other embodiments of the present invention will be explained with reference to the appended drawings. It is to be noted that the same components as those of the first embodiment are denoted by the same reference numerals in the following embodiments.

The second embodiment will be described in paragraphs that follow. The second embodiment shows an image forming apparatus using a xerography system which is employed in a laser printer. It is to be noted that the image forming apparatus can also be employed in a fax machine or a color or monochrome copier.

Figure 13:
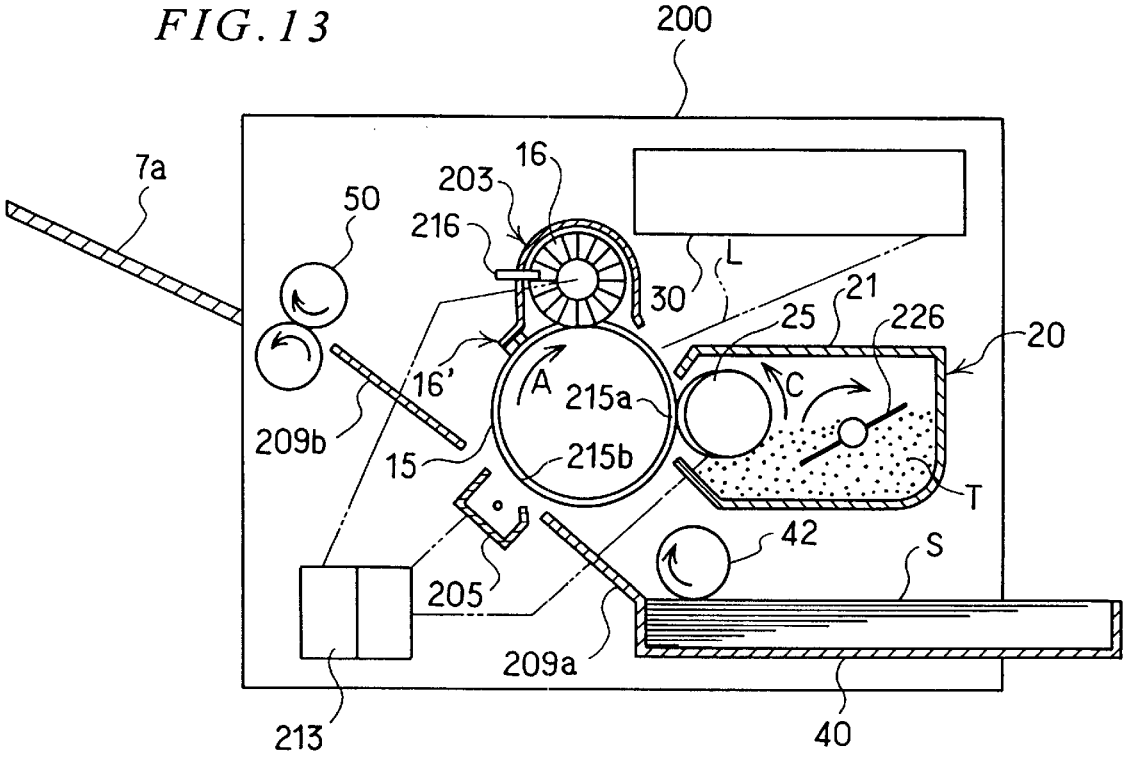
FIG. 13 is a cross-sectional view of a laser printer according to the second embodiment of a present invention.

As shown in FIG. 13, a laser printer 200 comprises a developing unit 20, a charging unit 203 and a transfer unit 205 around a cylinder-shaped photoreceptor 15, and also comprises a laser exposure unit 30. Further, the laser printer 200 is provided with a controller (not shown in the figure) for controlling the entire action of the apparatus. In a lower part of the laser printer 200, there is provided a power source 213 for supplying predetermined voltages into the components such as the developing unit 20, charging unit 203, and transfer unit 205.

The photoreceptor 15 the surface of which is coated with a photoreceptive layer, is rotated into the clockwise direction (shown by an arrow A) in FIG. 13 by the controller. The charging device 203 charges the photoreceptive layer to a predetermined potential. Then, the laser exposure unit 30 emits a laser beam L onto the photoreceptor 15 at a downstream position to the charging unit 103 in the rotational direction according to image data, which generates potential-attenuated parts for forming an electrostatic latent image on the photoreceptive layer which is charged in the predetermined potential by the charging unit 203.

The developing unit 20 forms (reveals) a toner image by providing toner T on the electrostatic latent image at a developing area 215*a* of the photoreceptor 15. Concurrently, the developing unit 20 collects the toner T which remains on the photoreceptor 15 at the collecting area 215*a* (which is also the developing area in the present embodiment).

More concretely, the developing unit 20 comprises a casing 21 adjacent to the photoreceptor 15. The casing 21 contains the toner T which is one of non-magnetic elements having a frictionally-charging ability. The casing 21 also includes a developing sleeve 25 and a stirring blade 226. The stirring blade 226 rotates in a reverse direction to the rotational direction (shown by an arrow C) of the developing sleeve 25, by which the toner T is supplied into the developing sleeve 25 without solidifying.

The developing sleeve 25 rotates in the arrow C direction with contacting with the surface of the photoreceptor 15 at an opening of the casing 21. At the same time, the voltage from the power source 213 applies the developing bias to the developing sleeve 25. Thereby, the toner T, which is held in a layer state around the developing sleeve 25, is conveyed onto the photoreceptor 15 as the developing sleeve 25 rotates. Accordingly, the toner T is deposited on the electrostatic latent image of the developing area 215*a* of the photoreceptor 15 for revealing the image.

In order to collect the residual toner T on the photoreceptor 15 into the casing 21, the developing sleeve 25 reaches a higher potential than the photoreceptor 15. As a result, the residual toner T is statically attracted by the developing sleeve 25, and conveyed into the developing unit 20 from the collecting part 215*a* by the photoreceptor 15. Therefore, in the laser printer 200 of the present embodiment, the toner T remaining on the image carrier (photoreceptor 15) can be collected and recycled after transferring the image.

The laser printer 200 also comprises a paper feed unit 40 under the developing unit 20. The paper feed unit 40 contains image-transferred media such as sheets of paper (hereinafter referred to as paper) S on which a paper feed roller 42 is pressed. Further, in the laser printer 200, a paper conveying path is constructed along with paper guides 209*a* and 209*b* from the paper feed unit 40. The paper conveying path runs between the transfer unit 205 and photoreceptor 15, and then runs between a pair of rollers composing a fixing unit 50. In an outside of the laser printer 200, there is arranged a printout tray 7*a* so as to connect with the paper conveying path at a downstream to the fixing unit 50. Owing to this construction, when the roller 42 rotates in a direction shown by the arrow, the paper S is conveyed into the printout tray 7*a* after passing along the guides 209*a* and 209*b* between the transfer unit 205 and photoreceptor 15, and then between the rollers of the fixing unit 50.

The transfer unit 205 transfers the toner image of the photoreceptor 15 onto the paper S at the transfer area 215*b*. More specifically, the transfer unit 205 applies an electric field of a polarity opposite to an electric field applied by the charging unit 203 into the photoreceptor 15, and the transfer unit 205 transfers the toner image of the surface of the photoreceptor 15 onto the paper S by statically attracting the toner T. The fixing unit 50 fixes the transferred toner image on paper S.

Figure 14:
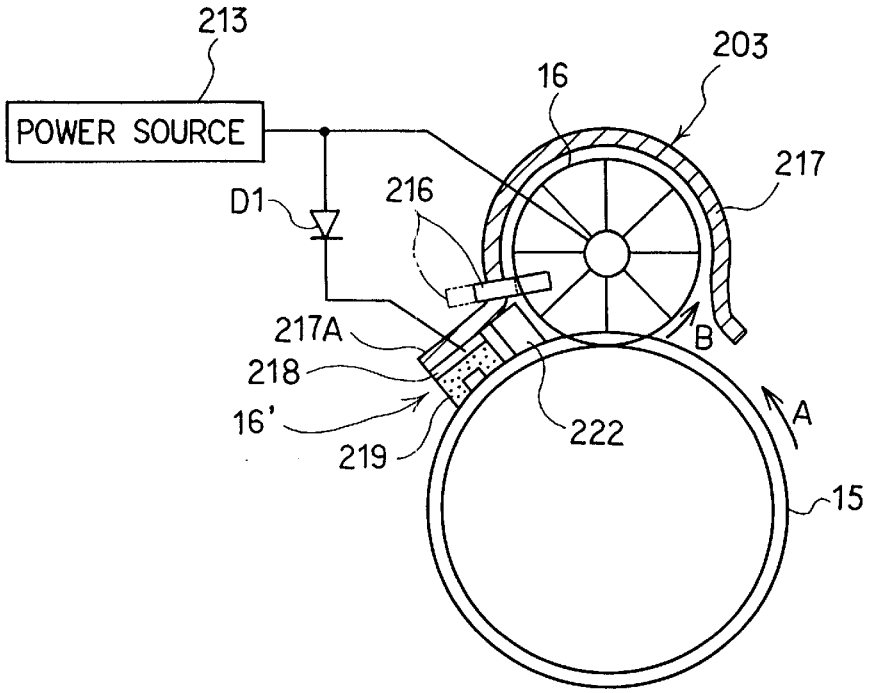
FIG. 14 is a schematic view of a photoreceptor unit of the present invention.

As shown in FIG. 14, the charging unit 203 comprises a conductive brush 16, a pre-charge sheet 16', a flick member 216 and a cover 217. The conductive brush 16 charges the photoreceptor 15 with electricity. The pre-charge sheet 16' is charged with electricity at an upstream position of the rotational direction of the photoreceptor 15 prior to the brush 16. The flick member 216 touches with and separates from the conductive brush 16. The cover 217 covers the conductive brush 16 and flick member 216 from above.

The conductive brush 16 is a base elementary tube in which rayon bristles with dispersed conductive particles such as carbon are implanted in a density of 10,000–15,000/inch. The conductive brush 16 has the same length as the photoreceptor 15 in a spindle direction, and is arranged such that the implanted bristles will dig slightly (predetermined as about 1–3 mm) into the photoreceptor 15 in order to maintain a contact stability between the conductive brush 16 and the photoreceptor 15.

The conductive brush 16, which is connected to the power source 213, discharges electricity at ends of the bristle with rotation in an arrow B direction by applying a DC (direct current) voltage (e.g., 1200V), a voltage switched from a DC voltage, or a voltage superimposing AC (alternating current) component on a DC voltage. Thereby, the surface of the photoreceptor 15 is charged with electricity.

Further, the pre-charge sheet 16' is equipped with a conductive support plate 218 and an elastic member 219. The conductive support plate 218 is attached on the underside of a support part 217A which extends from the cover 217 in a slant-downward direction. The elastic member 219 is attached on the underside of the conductive support plate 218, and in pressure contact with the outer surface of the photoreceptor 15.

The conductive support plate 218 of the pre-charge sheet 16' is connected to the power source 213 through a diode D1. At innumerable press-contact points between the photoreceptor 15 and the elastic member 219 which contact with the plate 218, there generates a charge-injected phenomenon based on the potential difference between the power source 213 and the photoreceptor 15. Further, there are spaces formed by later-described foam-cells in close proximity to the press-contact points, which generates a discharge phenomenon in the infinitesimal spaces, and increases the surface potential of the photoreceptor 15. Thereby, the photoreceptor 15 is previously charged with electricity. Owing to the pre-charging of the pre-charge sheet 16' and the charging of the conductive brush 16, the photoreceptor 15 is uniformly charged with electricity (e.g., from −300V to −600V).

The elastic member 219, which is arranged at the upstream to the conductive brush 16 between the transfer area 215*b* and collecting area 215*a* (FIG. 13), is made of a conductive ether-based polyurethane foam body (e.g., conductive Moltopren™, produced by Farbenfabriken Bayer A.G. Co.) and has a plurality of foam cells of diameters from 0.1–1.0 mm.

The above-mentioned foam cells are larger than the toner particles in diameter, and smaller than foreign matter D, such as paper particles (refer to FIGS. 15 and 16), in size. The foam cells are about 0.3 mm on average. The hardness of the elastic member 219 is about 0.15 kg/cm$^2$, and the force of pressing onto the surface of the photoreceptor 15 is about 0.1 kg/cm$^2$.

As mentioned above, the elastic member 219 is a foam body having a plurality of the cells (hollows), which presses on the outer surface of the photoreceptor 15 in innumerable points. Owing to this construction, the foam cells of the elastic member 219 remove the foreign matter D such as a special-coating material of the paper S and paper particles which are deposited on the surface of the photoreceptor 15. The foam cells of the elastic member 219 let the residual toner T on the surface of the photoreceptor 15 pass through. In this case, the conductive Moltopren™ is suitable for the elastic member 219.

However, when the foreign matter D deposited on the photoreceptor 15 increases in amount, the foreign matter D may pass through the elastic member 219, or solidify in the foam cells. The foreign matter D which has passed through the elastic member 219, is gathered together with the residual toner T into the casing 21, which causes image degradation, or the solidified foreign matter D causes damages on the surface of the photoreceptor 15.

Figure 16:
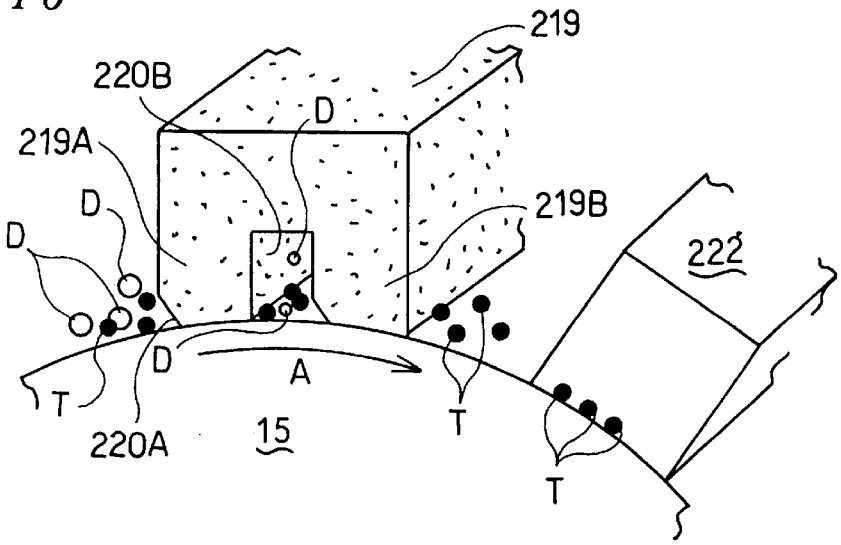
FIG. 16 is an enlarged perspective view of an elastic member and a flexible member used in the laser printer of the present invention.

To cope with the above-mentioned problems, as shown in FIG. 16, the foreign matter D which is deposited on the photoreceptor 15, is caught in an upstream position to the press-contact points between the elastic member 219 and the photoreceptor 15, and in the central part of the elastic member 219. For example, the elastic member 219 is provided with foreign matter catching spaces 220A and 220B which extend in the longitudinal direction of the photoreceptor 15 across the direction of conveying the toner T (the arrow A direction). Owing to this construction that the foreign matter catching spaces 220A and 220B catch the foreign matter D, which is deposited on the photoreceptor 15, upstream of the press-contact points between the elastic member 219 and the photoreceptor 15, find in the central part of the elastic member 219, the amount of the foreign matter D to be absorbed by the elastic member 219 is decreased.

In this case, the space 220B in the central part of the elastic member 219 is structured so as to be placed between the elastic portions 219A and 219B on the surface of the photoreceptor 15. Further, it is to be desired that the space 220A at the upstream position be structured so as to catch larger foreign matter D than the space 220B at the downstream position does. Due to the structure that the space 220A selects and catches the larger foreign matter D, and the space 220B selects and catches the smaller foreign matter D, the foreign matter D is prevented from solidifying in the spaces 220A and 220B.

Specifically, compared to the elastic portion 219A at the upstream position between the spaces 220A and 220B, the elastic portion 219B at the downstream position to the space 220B is higher in density. Compared to the elastic portion 219A, the elastic portion 219B is made to be a higher hardness by foam cells of smaller diameters. For example, while the elastic portion 219A has foam cells of 45–70/inch, the elastic portion 219B has foam cells of 50–120/inch. Due to this construction that the space 220A at the upstream position catches the larger foreign matter D than the space 220B does, the space 220A selects and catches the larger foreign matter D, and the space 220B selects and catches the smaller foreign matter D.

As a result, the amount of the foreign matter D to be absorbed by the elastic member 219 is much decreased, which prevents the foreign matter D from solidifying. Consequently, contrasted with the prior art, the foreign matter D such as paper particles which gathers and solidifies in the foam cells, does not damage the surface of the photoreceptor 15.

Figure 17A:
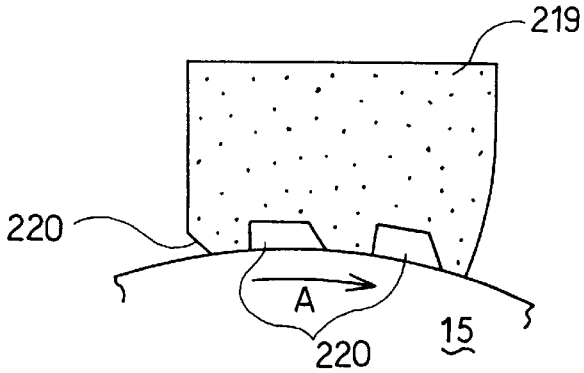
FIGS. 17(*a*) and 17(*b*) are enlarged side views of the elastic member used in alternative embodiments of the present invention.
Figure 17B:
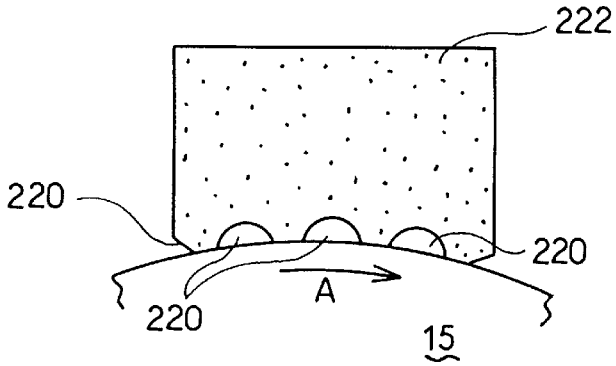

FIGS. 17(*a*) and 17(*b*) show modified embodiments in which three or more foreign matter catching spaces 220 are arranged in the arrow A direction of conveying the toner T remaining on the photoreceptor 15.

Figure 18:
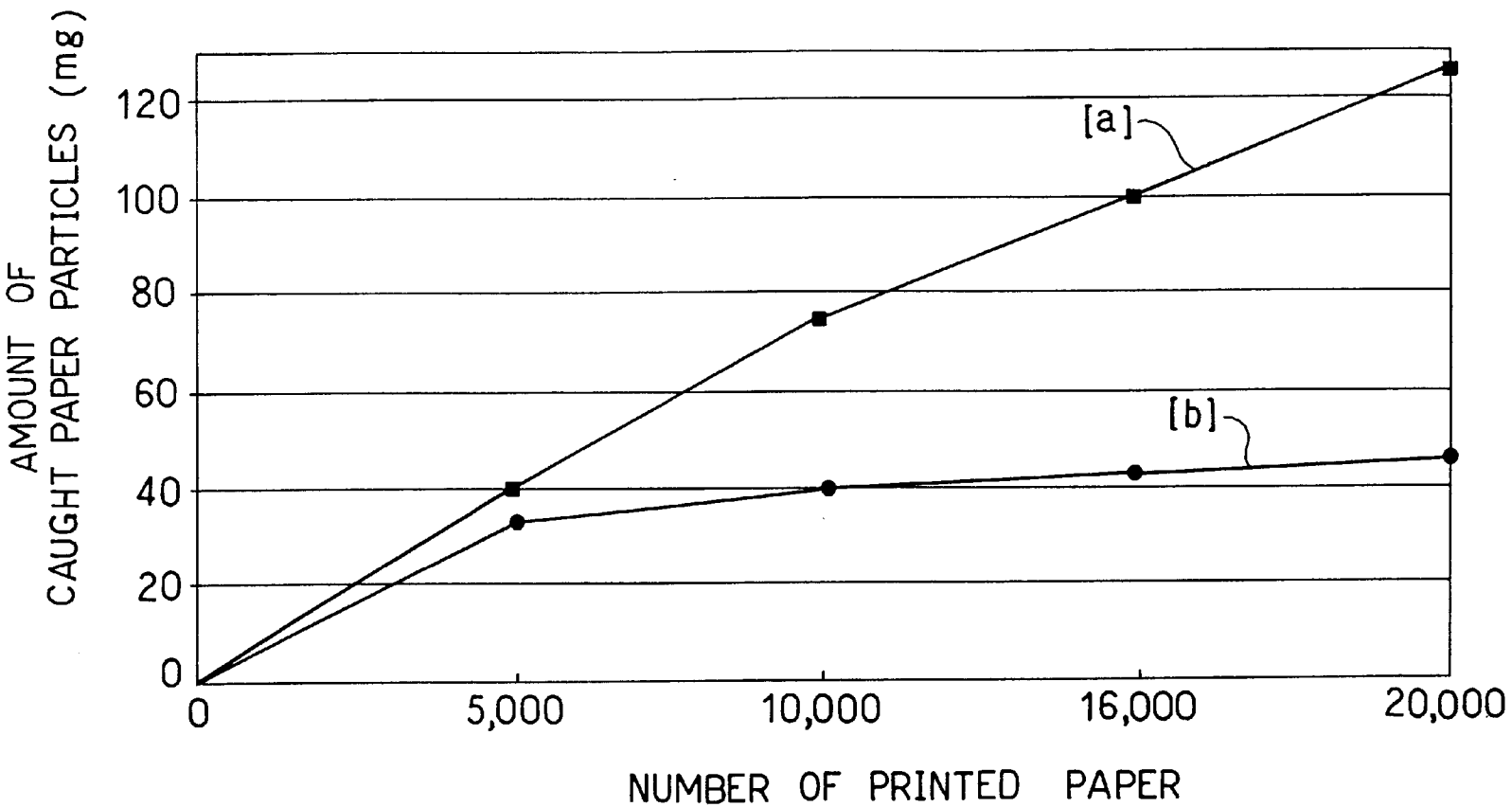
FIG. 18 is a graph of a relationship between the number of printed pages and the amount of caught paper particles.

FIG. 18 illustrates data from an experiment in which the spaces 220 are arranged in the elastic member 219 (line (a)), and from an experiment in which the spaces 220 are not arranged in the elastic member 219 (line (b)). In the line (a), the amount of the foreign matter D, which is caught by the space 220, increases in proportion to the number of printed sheets. On the contrary, as shown in the line (b), after 5000 sheets of paper are printed, the foreign matter D passes through the space between the elastic member 219 and the surface of the photoreceptor 15 without being caught.

In the case that the elastic member 219 has none of the foreign matter catching spaces 220, as the number of printed papers increases in the laser printer 200, and the amount of the foreign matter passing through the elastic member 219 increases, so does the amount of the foreign matter accumulating in the foam cells of the elastic member 219. In such a case, the elastic member 219 cannot afford to catch the foreign matter D. On the contrary, in the case that the elastic member 219 has the foreign matter catching spaces 220, the foreign matter accumulates in the space 220, so that the amount of the foreign matter accumulating in the foam cells of the elastic member 219 decreases, and a lower amount of foreign matter D escapes from the elastic member 219. Therefore, even if the number of the printed pages increases, the foreign matter D is prevented from mingling into the collected toner T.

However, some of the residual toner T may be deposited onto the conductive brush 16. In order to eliminate the residual toner T deposited on the conductive brush 16, there is provided a flick member 216 which touches and separates from the conductive brush 16 as shown in FIG. 14

Specifically, the flick member 216 touches the conductive brush 16 by moving into a position shown by the solid-line, then flicks the residual toner T from the brush, and drops it onto the photoreceptor 15. In this case, if the flick member 216 touches the conductive brush 16 at all times, the planted bristles in the conductive brush 16 are bent, so that, the flick member 216 is structured to move away into a position shown by a phantom line in FIG. 14.

Figure 23:
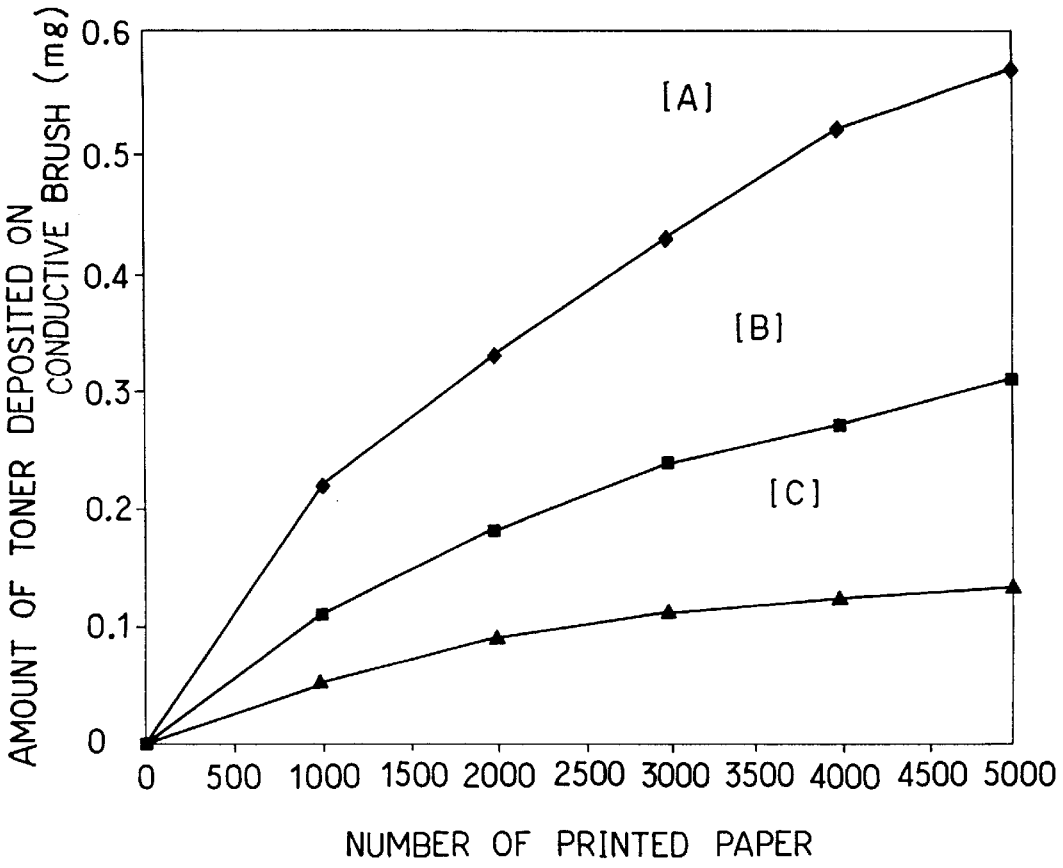
FIG. 23 is a graph of a relationship between the number of printed pages and the amount of toner deposited on the conductive brush.

FIG. 23 illustrates data from an experiment in which the flick member 216 is not arranged (line (A)), and from experiments in which the flick member 216 touches the conductive brush 16 in predetermined length (lines (B) and (C). In the line (A), the amount of the toner T deposited on the conductive brush 16 increases in proportion to the number of printed pages. As shown in the line (B) in which the flick member 216 touches the conductive brush 16 in predetermined length, a lower amount of the toner T than shown in line (A) is deposited on the conductive brush 16. Further, as shown in line (C) in which the flick member 216 touches the conductive brush 16 in predetermined length longer than in the line (B), still a lower amount of the toner T than shown in lines (A) and (B) is deposited on the conductive brush 16 in proportion to the number of printed pages at a former stage. Following the former stage, an approximately fixed amount of the toner T is deposited. Due to the structure that the flick amount of the toner T is deposited. Due to the structure that the flick member 216 touches the conductive brush 16, the residual toner T deposited on the brush is flicked off.

As shown in FIG. 16, at a downstream position to the elastic member 219 in the arrow A direction of conveying the residual toner T, there is arranged a flexible member 222 such as a special urethane foam. The flexible member 222 presses the residual toner T onto the photoreceptor 15, and makes the pressed toner T rub the surface of the photoreceptor 15. Specifically, it is desired that the flexible member 222 have material characteristics of a frictional coefficient of 0.5–1.5, a hardness of Asker C 20° or less, and a surface roughness of 5 $\mu$m or less. Further, it is more desired that the flexible member 222 have material characteristics of a hardness of Asker C 5°–20°, and a surface roughness of 0.3–2 $\mu$m.

If the flexible member 222 has the above-mentioned desired characteristics, the residual toner T, deposited on the photoreceptor 15, is sunk into the flexible member 222, and so the residual toner T gives no serious damage onto the photoreceptor 15. Thereby, the image to be formed on the paper S is prevented from being degraded. Owing to the structure that the flexible member 222 presses the residual toner T onto the photoreceptor 15, and makes the pressed toner T rub the surface of the photoreceptor 15, the surface of the photoreceptor 15 is renewed and prevented from being filmed. This makes it possible to avoid nonuniformity in charging, exposing and developing.

Figure 15:
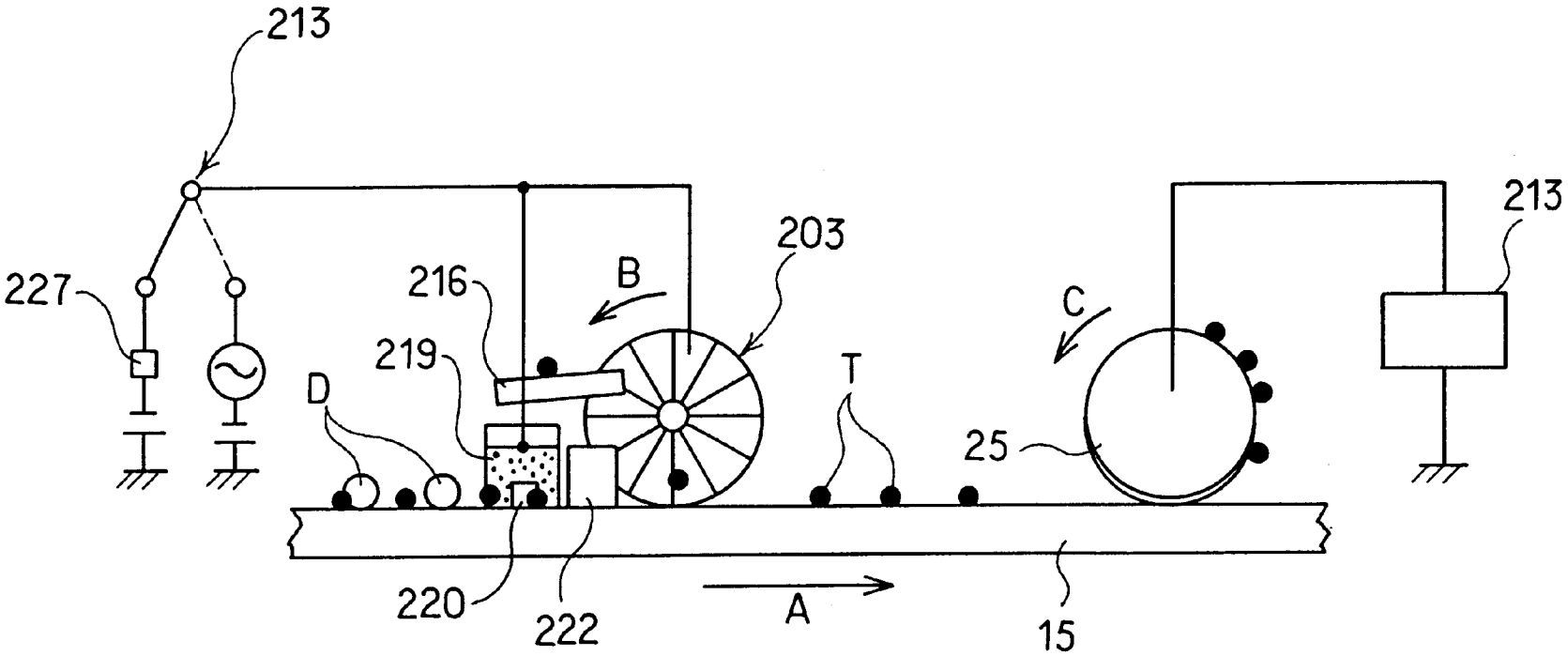
FIG. 15 is a schematic view of the laser printer of the present invention.

Next, the actions of the laser printer 200 will be explained with reference to FIGS. 13–15. In FIG. 15, which illustrates the collection of the toner T, it is assumed that the toner T is negatively polarized and the surface of the photoreceptor 15 is shown planar for convenience in explaining.

In an area for forming the image, changing over a switch of the power source 213 to a position shown by the solid line in FIG. 15 applies the voltage switched from the DC voltage (−1200V) by a switching element 227, or changing over a switch of the power source 213 to a position shown by a broken line applies the voltage superimposing the AC component on the DC voltage. The waveform voltage of these sorts are applied because the surface of the photoreceptor 15 is charged much more uniformly than in the case that the DC voltage is applied.

At start-up of the laser printer 200, when the photoreceptor 15 rotates in the arrow A direction shown in FIG. 13, the photoreceptive layer on the surface is charged at the predetermined potential at the time of passing through the charging unit 203. After that, when the photoreceptive layer, which has been charged at the predetermined potential, reaches the position for laser-exposure, the photoreceptive layer is exposed to the laser beam L according to the image data and the electrostatic latent image is formed. With the further rotation of the photoreceptor 15, the developing unit 20 receives the toner T at the developing area 215*a*, then forms the toner image on the electrostatic latent image, after which, the photoreceptor 15 rotates with carrying the toner image on the surface thereof.

At the time that the toner image reaches the transfer unit 205 where the transfer potential is applied to the photoreceptor 15, the toner image is attracted and transferred into the paper S. After that, the paper S on which the toner image is transferred, passes through the fixing unit 50 for fixing the toner image, and then the paper S is conveyed into the printout tray 7*a*.

As shown in FIG. 15, the toner T, which remains on the photoreceptor 15 without being transferred into the paper S, is mingled with the foreign matter D, such as the paper particles which were included with the paper S. Both of the residual toner T and foreign matter D are conveyed to the elastic member 219 with the rotation of the photoreceptor 15.

Here, the residual toner T, which has particles that are smaller than the foam cells in diameter, passes through the elastic member 219 which is pressed onto the photoreceptor 15, whereas the foreign matter D, which is much larger than the foam cells in diameter, cannot pass through the elastic member 219, and then the larger foreign matter D is caught by the foreign matter catching spaces 220 at the upstream position.

After that, the flexible member 222 presses the residual toner T onto the photoreceptor 15, and the pressed toner T rubs the surface of the photoreceptor 15. The flick member 216 touches the conductive brush 16, then flicks the residual toner T from the brush, and drops it onto the photoreceptor 15.

This residual toner T is conveyed by the photoreceptor 15 into the developing unit 20, statically attracted by the developing sleeve 25 which is at a higher potential, and collected by the casing 21.

In the above-mentioned case, the residual toner T passes through the elastic member 219 which receives a negative voltage from the power source 213, so that the residual toner T is negatively charged. Also, the electrostatic latent image which slightly remains on the surface of the photoreceptor 15, is removed since the charging eliminates the potential difference on the photoreceptor 15.

Figure 19:
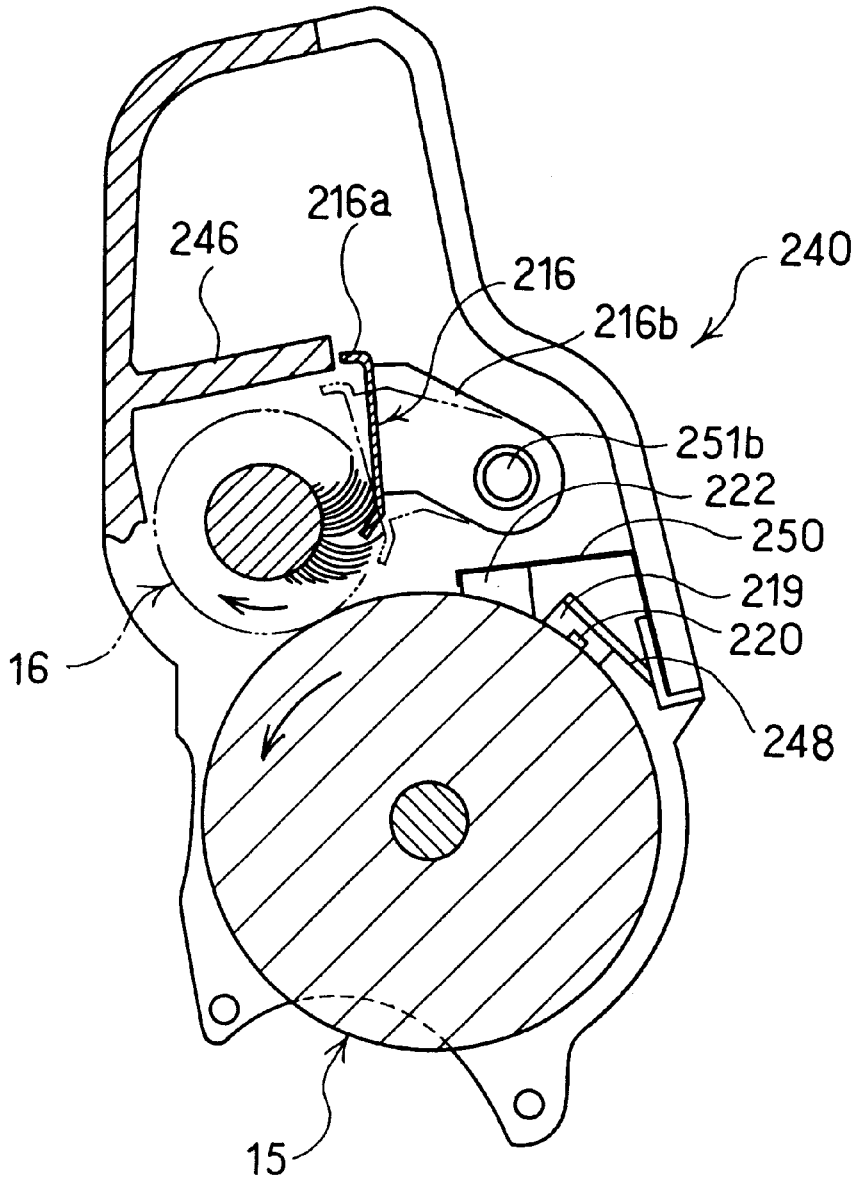
FIG. 19 is a cross-sectional view of a photoreceptor unit according to a third embodiment of the present invention.

Now, the third embodiment of the present invention will be explained with regard to FIG. 19 which shows an image-carrier cartridge 240 (hereinafter referred to as a cartridge) for containing the photoreceptor 15. The cartridge 240 is installed in the image forming apparatus such as the laser printer 200.

The cartridge 240 comprises the photoreceptor 15, conductive brush 16, the elastic member 219, the flexible member 222, the flick member 216 and an upper cover 246. It is noted that the cartridge 240 can comprise other components in addition to the above-mentioned ones. In such a construction, the conductive brush 16 charges the surface of the photoreceptor 15 as it rotates in a clockwise direction. The elastic member 219, which presses onto the surface of the photoreceptor 15, consists of a foam body having a plurality of foam cells of 0.1–1.0 mm in diameter. The flexible member 222, which is arranged at a downstream position to the elastic member 219 in the rotational direction of the photoreceptor 15, presses the residual toner T onto the photoreceptor 15, and makes the pressed toner T rub the surface of the photoreceptor 15. The flick member 216 touches and separates from the conductive brush 16. The cover 246 covers the conductive brush 16 and other components from above.

As mentioned in the second embodiment, the conductive brush 16 is a base elementary tube in which rayon bristles with the dispersed conductive particles such as carbon are implanted. In the third embodiment, each of the implanted bristles is curved, and the ends of the bristles form a circumferential surface as a whole. In order to carry the toner T, which is flicked and dispersed from the conductive brush 16 by the flick member 216, onto the surface of the photoreceptor 15, it is desired that the cover 246 and flick member 216 be structured so as to be as close to the circumferential surface formed by the ends of the planted bristles as possible.

The elastic member 219 is arranged at the upstream position to the conductive brush 16 in order to gather and catch foreign matter D, such as paper particles, deposited on the photoreceptor 15. As in the case of the second embodiment, the elastic member 219 in the third embodiment is also equipped with the foreign matter catching space 220. The elastic member 219 is pressed onto the photoreceptor 15 through a pressing member 248 which is disposed inside the cover 246. The flexible member 222 which is positioned between the elastic member 219 and conductive brush 16, is pressed onto the surface of the photoreceptor 15 by an elastic pressing member 250, consisting of a plate spring, without being over-pressed. Accordingly, the residual toner T, which is pushed by the flexible member 222, properly rubs the surface of the photoreceptor 15 without giving serious damage thereto.

The flick member 216 touches and separates from the conductive brush 16 in order to flick the toner T deposited on the ends of the brush. Specifically, in the cartridge 240 shown in FIG. 19, the flick member 216 is arranged close to the conductive brush 16, and supported by a supporting member 251b as a contact-separate means for contacting and separating the flick member 216 into and from the brush 16.

Figure 20:
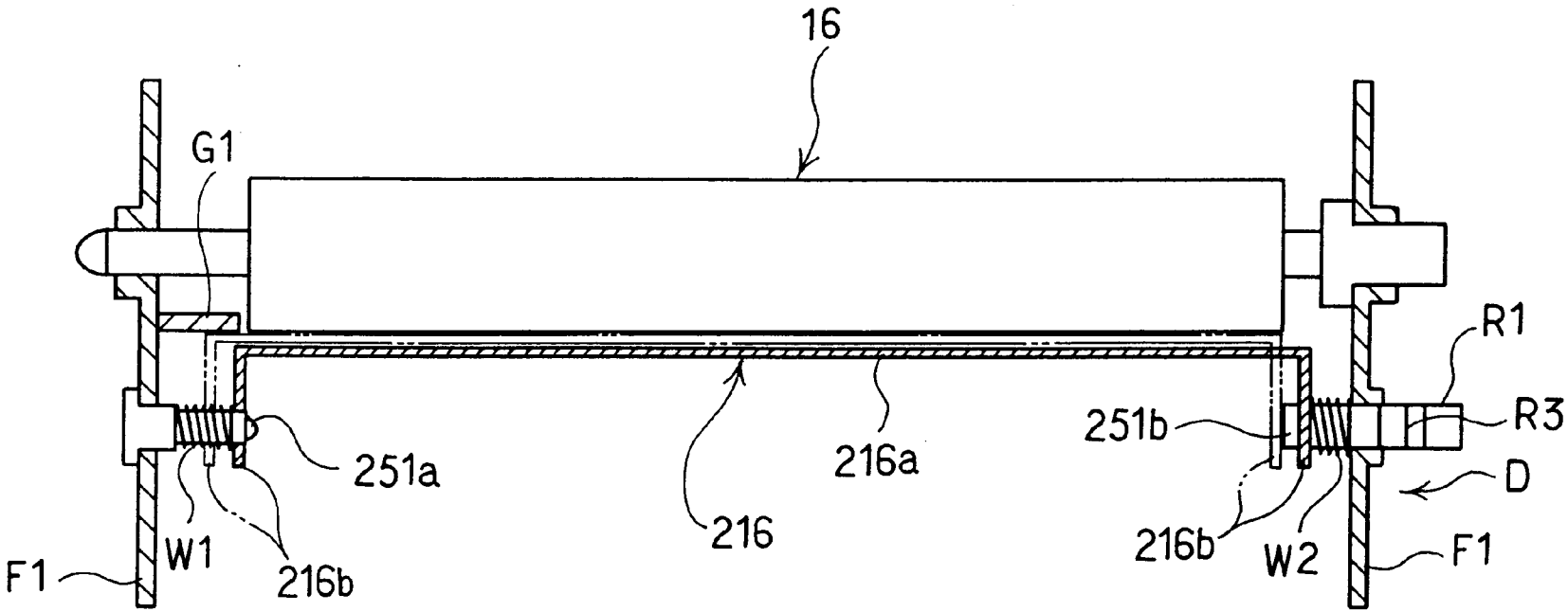
FIG. 20 is a side view of the photoreceptor unit of a third embodiment of the present invention.

When the flick member 216 touches the conductive brush 16 so as to dig into the brush (shown by a solid line of FIG. 19), the supporting member 251*b* moves in an arrow D direction as shown in FIG. 20. When the flick member 216 separates from the brush 16 (shown by a phantom line of FIG. 19), the supporting member 251*b* moves in an opposite direction to the arrow D as shown in FIG. 20.

More specifically, as shown in FIG. 20, the flick member 216 comprises a contact plane 216*a* extending between frames Fl, and right and left arms 216*b* supporting the contact plane 216*a*. The arms 216*b* are linked with supporting members 251*a* and 251*b* which are fastened into the frames Fl. The supporting member 251*a*, which is fastened into the left frame Fl in the figure, is wrapped with a spring Wl in order to separate the contact plane 216*a* from the ends of the brush 16 (shown by a solid line in FIG. 20). On the other hand, the supporting member 251*b*, which is fastened into the right frame Fl in the figure, is wrapped with a spring W2 in order to contact the contact plane 216*a* into the brush 16 (shown by a phantom line in FIG. 20).

Figure 21A:
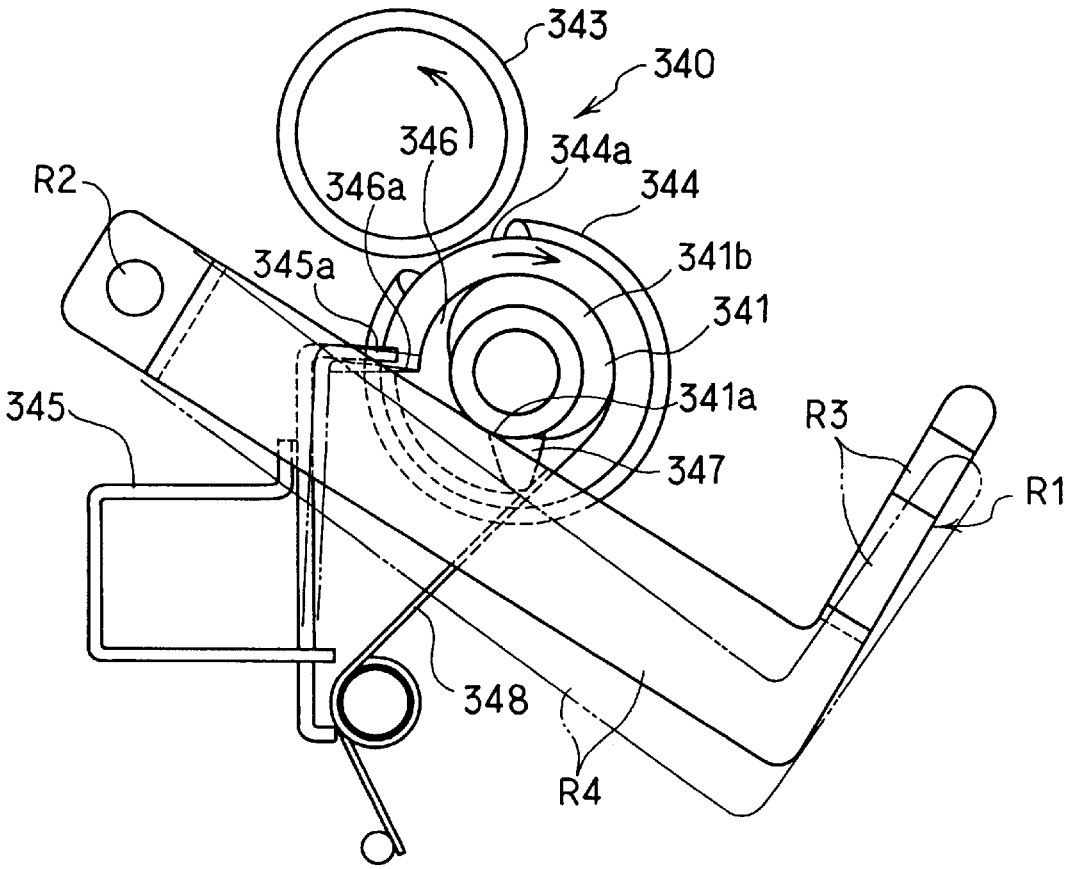
FIG. 21(*a*) is a side view of a mechanism for contacting with and separating from a conductive brush and a flick member in the photoreceptor unit of the present invention.
Figure 21B:
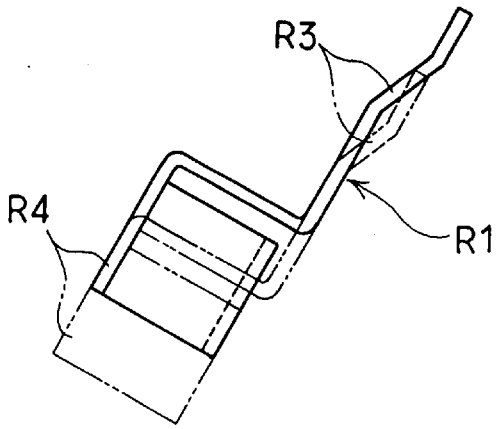

As shown in FIGS. 20 and 21, the right frame Fl, having the supporting member 251*b*, is equipped with an actuating lever Rl. When a contact part R3 of the lever Rl pushes the supporting member 251*b*, the supporting member 251*b* is urged by the spring W2, and moves both the arms 216*b* and the contact plane 216*a* of the flick member 216 into the arrow D direction against the urging force of the spring Wl. The left arm 216*b* is guided by a guiding member G1 fixed to the left frame F1, owing to which, the contact plane 216*a* touches the ends of the brush 16. Thereby, the toner T deposited on the brush 16 is flicked. This makes it possible to prevent the brush from becoming dirty and prevent degradation in charging which causes image noise or filming.

When the contact part R3 of the lever Rl stops pushing the right supporting member 251*b*, the left arm 216*b* is urged by the spring Wl while being guided by the guide member G1, and moves both the arms 216*b* and the contact plane 216*a* of the flick member 216 into the opposite direction to the arrow D. Thereby, the contact plane 216*a* separates from the brush 16, so that bristles of the brush 16 are prevented from being bent. This prevents degradation in the charging performance of the brush 16, and also prevents degradation in the image quality.

Next, the explanation will be given to the lever Rl for moving the right supporting member 251*b* with reference to FIGS. 21(*a*) and 21(*b*) respectively showing a plan view and a side view of a mechanism for moving the lever Rl upward and downward.

The lever Rl is structured so as to flick by pivoting on a fulcrum R2 between a solid line and a phantom line. Due to the flicking movement of the lever R1, the contact part R3 of the lever R1 makes the supporting member 251*b* travel between the right and left of FIG. 20. More specifically, in FIG. 21, a driving force from a later-described driving mechanism 340 for rotating the photoreceptor 15 makes an outer surface of a cam 341 (turning clockwise) push down a body R4 of the lever R1. Thereby, the lever R1 flicks, pivoting on the fulcrum R2, and the contact part R3 of the lever RI moves right and left, as shown in FIG. 20.

The above-mentioned driving mechanism 340 comprises a drive-input gear 343, a driving gear 344, a solenoid 345 and a first cam 346. The drive-input gear 343 always rotates in the counterclockwise direction, as shown in FIG. 21(*a*), for rotating the photoreceptor 15. The driving gear 344, which has a portion without teeth 344*a*, is engaged with the drive-input gear 343. The solenoid 345 engages the driving gear 344 with the drive-input gear 343 and disengages them by moving an actuating piece 345*a* through the portion without teeth 344*a*. The cam 346 rotates clockwise when the actuating piece 345*a* is out of touch with a receiver 346*a*, and the cam 346 stops rotating when the actuating piece 345*a* is in touch with the receiver 346*a*. Further, the driving mechanism 340 comprises the previously-mentioned cam 341 and a coil spring 348. The cam 341 rotates in the clockwise direction in combination with the cam 346. The coil spring 348 urges a second cam 347 such that the cam 347 will rotate in the clockwise direction in combination with the cam 341.

Due to the above-described structure, the cam 347 is urged clockwise by the coil spring 348. However, if the actuating piece 345*a* touches the receiver 346*a* when the solenoid 345 is inactive, such that the actuating piece 345*a* is in a position shown by the phantom line, the cam 346 does not rotate in the clockwise direction. This being the case, the drive-input gear 343 is positioned in the portion without teeth 344*a*, and the driving gear 344 stops rotating without being driven by the drive-input gear 343.

In the above-mentioned case, the body R4 of the lever Rl touches a small-radial point 341*a* on the circumferential surface of the cam 341 (shown by a solid line in FIG. 21(*a*)), and the contact part R3 of the lever R1 is in the solid line position of FIGS. 21(*a*) and 21(*b*), and in the right directional position of FIG. 20. As a result, the contact plane 216*a* of the flick member 216 is separated from the conductive brush 16.

However, when the actuating piece 345*a*, moved by the solenoid 345, is not touching the receiver 346*a* of the cam 346 (when the actuating piece 345*a* is in the solid line position), the coil spring 348 urges the cam 347 in the clockwise direction. Therefore, the cam 347 starts to rotate slightly in the clockwise direction in combination with the driving gear 344, and the cams 341 and 346. Here, the drive-input gear 343 is detached from the portion without teeth 344*a*, and then, the driving gear 344 and drive-input gear 343 engage with each other. The driving gear 44 receives the driving force from the drive-input gear 343, so that the driving gear 344 rotates in the clockwise direction in combination with the cams 347, 346 and 341.

In the above-mentioned case, the body R4 of the lever R1 starts to move downward upon contacting on the circumferential surface of the cam 341. In the case that the body R4 is in touch with a large-radial point 41*b* (shown by the phantom line of FIG. 21(*a*)), the contact part R3 of the lever R1 is in the phantom line position in FIGS. 21(*a*) and 21(*b*), and is in the left directional position in FIG. 20. As a result, the contact plane 216*a* of the flick member 216 touches the conductive brush 16.

After that, when the driving gear 344, cams 346, 347 and 341 make one turn while the solenoid 345 is inactive, the actuating piece 345*a* again touches the receiver 346*a* of the cam 346, and then the drive-input gear 343 is positioned in the portion without teeth 344*a*.

Therefore, the driving gear 344 stops the clockwise rotation without being driven by the drive-input gear 343. At the time, the body R4 of the lever R1 is touching the small-radial point 341*a* in the circumferential surface of the cam 341 (shown by a solid line in FIG. 21(*a*)).

Accordingly, the contact part R3 of the lever Rl is in the solid line position in FIGS. 21(*a*) and 21(*b*), and in the right directional position in FIG. 20. As a result, the contact plane 216*a* of the flick member 216 is separated from the conductive brush 16. From then on, the same actions are repeated by the active state or inactive state of the solenoid 345.

Figure 22:
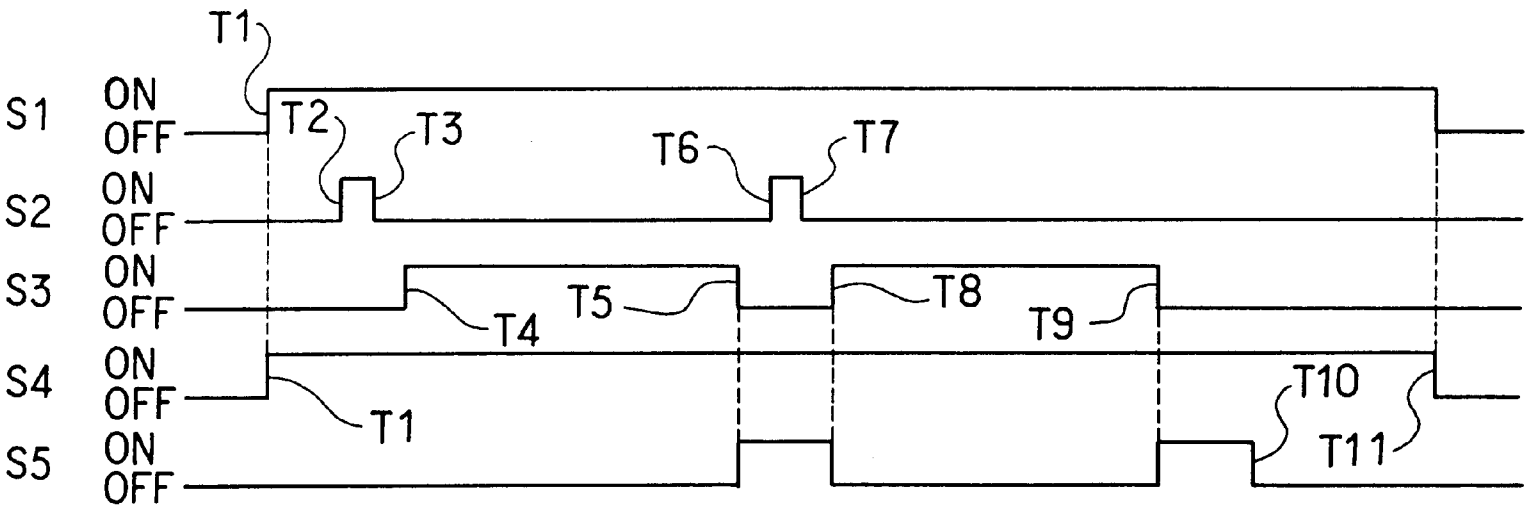
FIG. 22 is a graph of a timing sequence of the laser printer of the third embodiment.

Next, timing charts concerning the solenoid 345 and other components of the laser printer 200 will be explained with reference to FIG. 22.

The timing chart S1 shows a timing of the power source for activating the laser printer 200. The timing chart S2 shows a timing of feeding the paper S in the laser printer 200. The timing chart S3 shows a timing of forming the image in the laser printer 200. The timing chart S4 shows a timing of charging in the laser printer 200. The timing chart S5 shows a timing of the active state and inactive state of the solenoid 345. Hereinafter, each of the timings is referred to as Tx, wherein x represents a particular point in time within the timing cycle.

At the T1 of the S1 and S4, the power source 213 is turned on for activating the laser printer 200, and the charging operation by the conductive brush 16 and so on becomes in an on state. In the period from T2 to T3 in the S2, the paper feed roller 42 feeds a sheet of paper S on which the image is formed. In the period from the T4 to T5 in the S3, the image is formed in the laser printer 200. At the T5 in the S3, when the image forming operation is completed, the solenoid 345 is activated at the T5 in the S5. At the same time, the contact plane 216*a* of the flick member 216 is in touch with the ends of the conductive brush 16, and this state is maintained during the inactive state of the image forming, that is, until the T8.

In the period from the T6 to the T7 in the S2, that is the period from the T5 to the T8 in the S5, the feeding roller 42 feeds a second paper S. After that, in the period from the T8 to T9 in the S3, the laser printer 200 forms the image on the second paper S. After the image is completely formed on the second paper S at the T9 in the S3, the solenoid 45 activates at the T9 in the S5 for contacting the contact plane 216*a* of the flick member 216 on the brush 16, and this state is maintained during the inactive state of the image forming, that is, until the T10. At the T11 in the S1 and S4, the power source is turned off, and the charging operation becomes in an off state.

During the image forming operation, the supporting member 251*b* as a contact-separate means separates the flick member 216 from the conductive brush 16. Supposing the toner image T is transferred onto the paper S for forming the image, the toner T deposited on the conductive brush 16 stays there without dropping, so that the image forming operation is normally performed.

When the voltage from the power source 213 of the laser printer 200 is not applied (i.e. before the T1, or after the T11 in the S1), the flick member 216 is separated from the conductive brush 16, which prevents bristles of the conductive brush 16 from bending.

As explained above, according to the present embodiment, the electrostatic latent image which is formed by exposing the charged surface of the photoreceptor 15, is revealed with the toner T. After that, the toner T is transferred to the image-transferred media. Moreover, in the laser printer 200 in which the toner T remaining on the photoreceptor 15 after the image-transferring operation is collected at the downstream position for recycling, the elastic member 219 which is the foam body having a plurality of foam cells of 0.1–1.0 mm in diameter, is arranged between the transfer area 215*b* and collecting area 215*a* so as to be in pressure contact with the photoreceptor 15, and besides, the foreign matter catching spaces 220 for catching the foreign matter D deposited on the photoreceptor 15, are arranged elastic member 219 so as to extend across the direction of conveying the toner T.

Owing to the above-mentioned-construction, the elastic member 219 removes the foreign matter D such as the paper particles deposited on the photoreceptor 15, and lets the residual toner T pass through. Moreover, the foreign matter catching spaces 220 catch the foreign matter D deposited on the photoreceptor 15. As a result, the amount of the foreign matter D to be absorbed into the elastic member 219 is reduced, and the foreign matter D is prevented from solidifying.

The elastic member 219 has the foreign matter catching spaces 220A and 220B respectively at the upstream and downstream positions. The space 220A at the upstream position is structured so as to catch the larger foreign matter D than the space 220B does. Due to this structure, the space 220A selects and catches the larger foreign matter D, and the space 220B selects and catches the smaller foreign matter D.

Further, the laser printer 200 comprises the flexible member 222 which presses the residual toner T onto the photoreceptor 15, and makes the pressed toner T rub the surface of the photoreceptor 15. This makes it possible to prevent filming, and avoid nonuniformity in charging, exposing and developing. The flexible member 222 is pushed onto the photoreceptor 15 by the elastic pressing member 250. The pressing member 250 properly pushes the flexible member 222, so that the flexible member 222 does not over-rub the surface of the photoreceptor 15.

In the laser printer 200 in which the electrostatic latent image formed by exposing the charged surface of the photoreceptor 15, is revealed with the toner T, and then, the toner T is transferred onto the paper S, there are provided a flick member 216 and a supporting member 251*b*. The flick member 216 touches with the conductive brush 16 for flicking and dropping the toner T deposited on the conductive brush 16.

The above-mentioned structure makes it possible to prevent the brush from becoming dirty, then prevent degradation in charging which causes image noises or filming. Further, the flick member 216 can be separated from the conductive brush 16, which can prevent bristles of the conductive brush 16 from bending.

During the image forming operation, the supporting member 251*b* separates the flick member 216 from the conductive brush 16, so that the toner T deposited on the conductive brush 16 stays there without dropping, so that the image forming operation is normally performed.

Also, when the voltage from the power source 213 of the laser printer 200 is not applied, the flick member 216 is separated from the conductive brush 16, which prevents bristles of the conductive brush 16 from bending.

The present invention is not restricted to the above-described embodiments, but includes varied or modified embodiments from the above. Although the above-explained embodiment relates to the laser printer for monochrome printing, the present invention can also be applied in a color laser printer or a copier. Further, the conductive shields are provided in three places of the photoreceptor unit 10 in the first embodiment, but it is also possible to make a structure in which the conductive shield can be provided only in one place. Moreover, not limited to the structure of the above-mentioned grounding plate 105, various kinds of conductive structures can be employed for the short circuit between the body of the photoreceptor 15 and the conductive shields 101, 102 and 103. Further, it is possible to employ an image-carrier device other than the photoreceptor. Besides, it is also possible to structure such that the conductive brush 16 will move so as to touch and separate from the stationary flick member 216, or such that both of the conductive brush 16 and flick member 216 will be moved so as to touch with and separate from each other.

What is claimed is:

1. An image forming apparatus comprising:

a cartridge comprising an image carrier, a casing having an opening for opening up an predetermined area of said image carrier, a cover for covering and uncovering the opening of said casing, and an electrical shield arranged on a surface of said cover facing the image carrier;

a holder for holding the cartridge; and a mechanism for opening said cover.

2. An image forming apparatus as claimed in claim 1, wherein the electrical shield is made from a conductive material.

3. An image forming apparatus as claimed in claim 2, further comprising a conductive member for electrically connecting the electrical shield and a body of the image carrier.

4. An image forming apparatus as claimed in claim 3, wherein the conductive member remains connected to the electrical shield and the body of the image carrier until the cartridge is completely loaded in the holder.

5. An image forming apparatus as claimed in claim 3, wherein the conductive member remains connected to the electrical shield and the body of the image carrier when the cover covers the opening.

6. An image forming apparatus as claimed in claim 1, further comprising a contact point for making contact between the electrical shield and the image forming apparatus at the time of loading the cartridge in the holder before the body of the image carrier is electrically connected with the image forming apparatus.

7. An image forming apparatus as claimed in claim 6, wherein the contact point makes no contact between the electrical shield and the apparatus when the cartridge is completely loaded in the holder.

8. An image forming apparatus as claimed in claim 1, further comprising:

an electrostatic latent image forming device for forming an electrostatic latent image on a surface of the image carrier;

a developing device for revealing the electrostatic latent image on the surface of the image carrier with a developer;

a transfer device for transferring the image on the surface of the image carrier which has been revealed by the developer onto a medium;

a collecting device for collecting the developer which remains on the surface of the image carrier after transferring the image onto a medium; and an elastic member having a plurality of foam cells of 0.1 to 1.0 mm in diameter, wherein said elastic member is in pressure contact with the surface of the image carrier between said transfer device and collecting device.

9. An image forming apparatus as claimed in claim 8, wherein the elastic member has spaces which extend across a direction of conveying the developer for catching foreign matter which is deposited on the image carrier.

10. An image forming apparatus as claimed in claim 8, further comprising:

a conductive brush for charging the surface of the image carrier with electricity; and a flick member for contacting said conductive brush so as to flick the developer deposited on the brush.

11. An image forming apparatus as claimed in claim 1, further comprising:

an electrostatic latent image forming device for forming an electrostatic latent image on a surface of the image carrier;

a developing device for revealing the electrostatic latent image on the surface of the image carrier with a developer;

a transfer device for transferring the image on the surface of the image carrier which has been revealed by the developer;

a collecting device which collects the developer which remains on the surface of the image carrier after transferring the image to a medium; and a flexible member for pressing the remaining developer onto the image carrier so as to make the pressed developer rub the surface of the image carrier.

12. An image forming apparatus as claimed in claim 11, wherein the flexible member has a surface coefficient of friction of 0.5–1.5, a hardness of Asker C 20° or less, and a surface roughness of 5 $\mu$m or less.

13. An image forming apparatus as claimed in claim 11, further comprising:

a conductive brush for charging the surface of the image carrier with electricity; and a flick member for contacting said conductive brush so as to flick the developer deposited on the brush.

14. An image forming apparatus as claimed in claim 1, further comprising:

a conductive brush for charging the surface of the image carrier with electricity; and a flick member for contacting said conductive brush so as to flick the developer deposited on the brush.

15. An image carrier cartridge comprising:

an image carrier;

a casing for covering said image carrier, said casing having an opening which opens up a predetermined area of the image carrier;

a cover for covering said opening of the casing; and an electrical shield which is arranged on a surface of said cover facing the image carrier.

16. An image carrier cartridge as claimed in claim 15, wherein the electrical shield is a conductive material.

17. An image carrier cartridge as claimed in claim 16, further comprising a conductive member for electrically connecting the electrical shield and a body of the image carrier.

18. An image carrier cartridge as claimed in claim 17, wherein the conductive member remains connected to the electrical shield and the body of the image carrier until the cartridge is completely loaded into the apparatus employing the cartridge.

19. An image carrier cartridge as claimed in claim 17, wherein the conductive member remains connected to the electrical shield and the body of the image carrier when the cover covers the opening.

20. An image forming apparatus comprising:

an image carrier;

an electrostatic latent image forming device for forming an electrostatic latent image on a surface of the image carrier;

a developing device for revealing the electrostatic latent image on the surface of the image carrier with a developer;

a transfer device for transferring the image on the surface of the image carrier revealed by the developer onto a medium;

a collecting device for collecting the developer remaining on the surface of the image carrier after transferring the image; and an elastic member having a plurality of foam cells of 0.1 to 1.0 mm in diameter, wherein said foam cells allow toner to pass therethrough and said elastic member is in pressure contact with the surface of the image carrier between said transfer device and collecting device.

21. An image forming apparatus as claimed in claim 20, wherein the elastic member has spaces which extend across a direction of conveying the developer for catching foreign matter which is deposited on the image carrier.

22. An image forming apparatus as claimed in claim 21, wherein spaces of the elastic member include a first space at an upstream position and a second space at a downstream position along a direction in which the developer is conveyed, in which the first space catches larger-diameter foreign matter than the second space.

23. An image forming apparatus as claimed in claim 22, wherein a part which forms the first space in the elastic member has larger-diameter foam cells than a part which forms the second space.

24. An image forming apparatus as claimed in claim 22, wherein a part which forms the first space in the elastic member has a lower hardness than a part which forms the second space.

25. An image forming apparatus as claimed in claim 20, further comprising a flexible member for pressing the remaining developer onto the image carrier so as to make the pressed developer rub the surface of the image carrier.

26. An image forming apparatus as claimed in claim 20, wherein the developing device has a conveyance device for conveying the developer onto the surface of the image carrier, wherein the collecting device collects the developer using the conveyance device.

27. An image forming apparatus as claimed in claim 20, further comprising:

a conductive brush for charging the surface of the image carrier with electricity; and a flick member for contacting said conductive brush so as to flick the developer deposited on the brush.

28. An image forming apparatus comprising:

an image carrier;

an electrostatic latent image forming device for forming an electrostatic latent image on a surface of the image carrier;

a developing device for revealing the electrostatic latent image on the surface of the image carrier with a developer;

a transfer device for transferring the image on the surface of the image carrier revealed by the developer onto a medium;

a collecting device for collecting the developer remaining on the surface of the image carrier after transferring the image; and a flexible member for pressing the remaining developer onto the image carrier so as to make the pressed developer rub the surface of the image carrier.

29. An image forming apparatus as claimed in claim 28, wherein the flexible member has a surface coefficient of friction of 0.5–1.5, a hardness of Asker C 20° or less, and a surface roughness of 5 $\mu$m or less.

30. An image forming apparatus as claimed in claim 28, further comprising a pressing member for pressing the flexible member onto the surface of the image carrier.

31. An image forming apparatus as claimed in claim 28, wherein the developing device has a conveyance device for conveying the developer onto the surface of the image carrier, wherein the collecting device collects the developer by using the conveyance device.

32. An image forming apparatus as claimed in claim 28, further comprising:

a conductive brush for charging the surface of the image carrier with electricity; and a flick member for contacting said conductive brush so as to flick the developer deposited on the brush.

33. An image carrier cartridge, employed in an image forming apparatus, in which an electrostatic latent image, formed by exposing a charged surface of said image carrier, is revealed with a developer, and transferred onto recording media, wherein the developer remaining on the image carrier after transferring the image is collected at a downstream position, the image carrier cartridge comprising:

an image carrier;

an elastic member which is in pressure contact with the surface of the image carrier, wherein said elastic member has a plurality of foam cells of 0.1–1.0 mm in diameter.

34. An image carrier cartridge as claimed in claim 33, wherein the elastic member has spaces which extend across a direction of conveying the developer for catching foreign matter which is deposited on the image carrier.

35. An image carrier cartridge, employed in an image forming apparatus, in which an electrostatic latent image, formed by exposing a charged surface of an image carrier, is revealed with a developer and transferred onto recording media, wherein the developer remaining on the image carrier after transferring the image is collected at a downstream position, the image carrier cartridge comprising:

an image carrier;

a flexible member for pressing the remaining developer onto the image carrier so as to make the pressed developer rub the surface of the image carrier.

36. An image forming apparatus comprising:

an image carrier;

a conductive brush for charging a surface of the image carrier with electricity;

an electrostatic latent image forming device for forming an electrostatic latent image on the surface of the image carrier;

a developing device for revealing the electrostatic latent image on the surface of the image carrier with a developer;

a transfer device for transferring the image on the surface of the image carrier revealed by the onto a medium;

a flick member for contacting said conductive brush so as to flick the developer deposited on the brush; and a contacting-separating device for contacting the flick member with the conductive brush and for separating the flick member from the conductive brush.

37. An image forming apparatus as claimed in claim 36, wherein the contacting-separating device separates the flick member from the conductive brush during an image forming operation.

38. An image forming apparatus as claimed in claim 36, wherein the contacting-separating device separates the flick member from the conductive brush when a driving power source to the apparatus is turned off.

39. An image forming apparatus as claimed in claim 36, wherein the developing device has a conveyance device for conveying the developer onto the surface of the image carrier, wherein the conveyance device collects the developer remaining on the surface of the image carrier after transferring the image.

40. An image carrier cartridge, employed in an image forming apparatus, in which an electrostatic latent image, formed by exposing an image carrier surface charged through the conductive brush, is revealed with a and transferred onto image-transferred media, the image carrier cartridge comprising:

an image carrier;

a conductive brush for charging the surface of the image carrier with electricity;

a flick member for contacting said conductive brush so as to flick the developer deposited on the brush; and a contacting-separating device for contacting the flick member with the conductive brush and for separating the flick member from the conductive brush.

* * * * *

UNITED STATES PATENT AND TRADEMARK OFFICE

CERTIFICATE OF CORRECTION

PATENT NO: 6,038,415
DATED : March 14, 2000
INVENTOR(S): Masayuki Nishi et al.

It is certified that error appears in the above-identified patent and that said Letters Patent is hereby corrected as shown below:

Column 18, line 63 (claim 1, line 3), delete the second instance of "an", and insert --a--.

Column 22, line 42 (claim 36, line 12), after "by the", insert --developer--.

Column 22, line 65 (claim 40, line 4), after "with a", insert --developer--.

Signed and Sealed this

Fifth Day of June, 2001

*Attest:*

*Attesting Officer*

Nicholas P. Godici

NICHOLAS P. GODICI

*Acting Director of the United States Patent and Trademark Office*